US008026437B2

(12) United States Patent
Tanaka et al.

(10) Patent No.: US 8,026,437 B2
(45) Date of Patent: Sep. 27, 2011

(54) ELECTRONIC MUSICAL INSTRUMENT GENERATING MUSICAL SOUNDS WITH PLURAL TIMBRES IN RESPONSE TO A SOUND GENERATION INSTRUCTION

(75) Inventors: Ikuo Tanaka, Hamamatsu (JP); Yoshinori Iwamoto, Hamamatsu (JP)

(73) Assignee: Roland Corporation, Shizuoka-Ken (JP)

( * ) Notice: Subject to any disclaimer, the term of this patent is extended or adjusted under 35 U.S.C. 154(b) by 143 days.

(21) Appl. No.: 12/467,990

(22) Filed: May 18, 2009

(65) Prior Publication Data

US 2010/0077907 A1 Apr. 1, 2010

(30) Foreign Application Priority Data

Sep. 29, 2008 (JP) ..... 2008-250238

(51) Int. Cl.
*G10H 1/22* (2006.01)

(52) U.S. Cl. ..... 84/610; 84/609; 84/618; 84/645

(58) Field of Classification Search ..... 84/610
See application file for complete search history.

(56) References Cited

U.S. PATENT DOCUMENTS 4,205,576 A * 6/1980 Deutsch et al. ..... 84/609

(Continued)

FOREIGN PATENT DOCUMENTS

JP 57-128397 8/1982

OTHER PUBLICATIONS

US Application entitled "Electronic Musical Instrument", filed May 18, 2009, Serial No. unknown, by inventor I. Tanaka.

(Continued)

*Primary Examiner* — Elvin G Enad
*Assistant Examiner* — Christopher Uhlir
(74) *Attorney, Agent, or Firm* — Konrad Raynes & Victor LLP

(57) ABSTRACT

When the on-on time between Note 1 and Note 2 is shorter than the double stop judgment time JT, as shown in FIG. 3A, the mode is changed from Unison 1 to Unison 2. When note-on information of Note 1 is inputted at time t1, the parts 1-4 are assigned to Note 1, and simultaneously start sound generation at pitch n1, as shown in FIG. 3B. Next, when note-on information of Note 2 at pitch n2 lower than Note 1 is inputted at time t2, the mode is switched to Unison 2. Part 1 (with the timbre being trumpet) and Part 2 (with the timbre being clarinet) which are higher in the pitch order are assigned to Note 1, and continue generating the musical sound at pitch n1 of Note 1, and Part 3 (with the timbre being alto saxophone) and Part 4 (with the timbre being trombone) which are lower in the pitch order are assigned to Note 2, stop the sound generation at pitch n1, and start sound generation at pitch n2 of Note 2.

20 Claims, 14 Drawing Sheets

U.S. PATENT DOCUMENTS

| | | | | |
|---|---|---|---|---|
| 4,332,183 | A * | 6/1982 | Deutsch | 84/627 |
| 4,342,248 | A | 8/1982 | Deutsch et al. | |
| 5,056,401 | A * | 10/1991 | Yamaguchi et al. | 84/635 |
| 5,254,804 | A * | 10/1993 | Tamaki et al. | 84/626 |
| 5,610,353 | A * | 3/1997 | Hagino | 84/604 |
| 5,915,237 | A | 6/1999 | Boss et al. | |
| 6,958,442 | B2 | 10/2005 | Moussa | |
| 7,176,373 | B1 | 2/2007 | Longo | |
| 7,212,213 | B2 | 5/2007 | Steinberg et al. | |
| 7,709,723 | B2 | 5/2010 | Pachet et al. | |
| 7,714,222 | B2 | 5/2010 | Taub et al. | |
| 7,718,885 | B2 | 5/2010 | Lindemann | |
| 7,728,213 | B2 | 6/2010 | Stone et al. | |
| 7,790,977 | B2 | 9/2010 | Sato | |
| 2003/0177892 | A1 * | 9/2003 | Akazawa et al. | 84/616 |
| 2006/0054006 | A1 * | 3/2006 | Akazawa | 84/609 |
| 2006/0074649 | A1 | 4/2006 | Pachet et al. | |
| 2009/0049978 | A1 | 2/2009 | Sato | |
| 2009/0249943 | A1 | 10/2009 | Tanaka et al. | |

OTHER PUBLICATIONS

Preliminary Amendment for US Application entitled "Electronic Musical Instrument", filed May 18, 2009, Serial No. unknown, by inventor I. Tanaka.

U.S. Appl. No. 12/468,000, filed May 18, 2009, entitled "Electronic Musical Instrument", by inventor I. Tanaka.

Preliminary Amendment filed May 18, 2009 for U.S. Appl. No. 12/468,000, filed May 18, 2009, entitled "Electronic Musical Instrument", by inventor I. Tanaka.

First Office Action IFW dated Dec. 17, 2010, pp. 1-19, for U.S. Appl. No. 12/468,000, filed May 18, 2009 for inventor I. Tanaka.

Response dated Mar. 14, 2011, pp. 1-18, to First Office Action IFW dated Dec. 17, 2010 for U.S. Appl. No. 12/468,000, filed May 18, 2009 for inventor I. Tanaka.

Notice of Allowance dated Apr. 6, 2011, pp. 1-14, for U.S. Appl. No. 12/468,000 filed May 18, 2009 for inventor I. Tanaka.

* cited by examiner

ELECTRONIC MUSICAL INSTRUMENT GENERATING MUSICAL SOUNDS WITH PLURAL TIMBRES IN RESPONSE TO A SOUND GENERATION INSTRUCTION

CROSS-REFERENCE TO RELATED FOREIGN APPLICATION

This application is a non-provisional application that claims priority benefits under Title 35, Unites States Code, Section 119(a)-(d) from Japanese Patent Application entitled "ELECTRONIC MUSICAL INSTRUMENT" by Ikuo Tanaka and Yoshinori Iwamoto, having Japanese Patent Application Serial No. 2008-250238, filed on Sep. 29, 2008, which application is incorporated herein by reference in its entirety.

BACKGROUND

1. Technical Field

The present invention generally relates to electronic musical instruments, and more particularly, to electronic musical instruments capable of generating musical sounds with plural timbres in response to a sound generation instruction.

2. Related Art

Electronic musical instruments having a plurality of keys composing a keyboard, in which, upon depressing plural ones of the keys, different timbres are assigned to each of the depressed plural keys, and musical sounds at pitches designated by the depressed keys are generated with the timbres assigned to the depressed keys, are known. An example of such related art is Japanese Laid-open Patent Application SHO 57-128397.

Another electronic musical instrument known to date generates musical sounds with multiple timbres concurrently in response to each key depression. For example, musical sounds that are to be generated by different plural kinds of wind instruments (trumpet, trombone and the like) at each pitch may be stored in a memory, and when one of the keys is depressed, those of the musical sounds stored in the memory and corresponding to the depressed key are read out thereby generating the musical sounds. In this case, when one of the keys is depressed, musical sounds with plural timbres are simultaneously generated, which provides a performance that sounds like a performance by a brass band. However, when plural ones of the keys are depressed, musical sounds with plural timbres are generated in response to each of the depressed keys. Therefore, when the number of keys depressed increases, the resultant musical sounds give an impression that the number of performers has increased, which sounds unnatural.

Another known electronic musical instrument performs a method in which, when the number of the keys depressed is fewer, musical sounds with a plurality of timbres are generated in response to each of the keys depressed; and when the number of the keys depressed is greater, musical sounds with a fewer timbres are generated in response to each of the keys depressed.

However, in the electronic musical instruments of related art, timbres that can be assigned according to states of key depression are limited, and the performance sounds unnatural or artificial when the number of keys depressed changes. For example, when one of the keys is depressed, a set of multiple musical sounds is generated; and when another key is depressed in this state, the musical sounds being generated are stopped, and another set of multiple musical sounds is generated in response to the key that is newly key-depressed.

Furthermore, when plural ones of the keys are depressed at the same time, timbres to be assigned to the respective keys are determined; but when other keys are newly depressed in this state, the new key depressions may be ignored, which is problematical because such performance sounds unnatural.

SUMMARY

The invention has been made to address the problems described above. In accordance with an advantage of some aspects of the invention, there is provided an electronic musical instrument by which naturally sounding musical sounds can be generated even when the states of key depression are changed.

In accordance with an embodiment of the invention, an electronic musical instrument includes:

an input device that inputs a sound generation instruction that instructs to start generating a musical sound at a predetermined pitch and a stop instruction that instructs to stop the musical sound being generated by the sound generation instruction;

a plurality of parts that are assigned to the musical sound at the predetermined pitch whose sound generation is instructed by the sound generation instruction inputted by the input device and that generate the musical sound with set timbres;

a first sound generation control device that controls such that, when a sound generation instruction is inputted by the input device to start generation of a musical sound at a specified pitch, a predetermined number of parts among the plurality of parts are assigned to the musical sound whose sound generation is instructed, and the predetermined number of parts stop the musical sounds being generated and generate the musical sound whose sound generation is instructed;

a second sound generation control device that controls such that, when a sound generation instruction is inputted by the input device to start generation of a musical sound at a specified pitch, a predetermined number of parts among the plurality of parts are generally equally assigned to the musical sound being generated and the musical sound whose sound generation is instructed, and the respective assigned parts generate or continue generating the musical sound being generated and the musical sound whose sound generation is instructed;

an on-on time timer device that measures a time difference between a first sound generation instruction inputted by the input device and a second sound generation instruction inputted next to the first sound generation instruction; and a switching device that changes control by the first sound generation control device to control by the second sound generation control device after the second sound generation instruction, when the second sound generation instruction is given while the musical sound whose sound generation is instructed by the first sound generation instruction is controlled and generated by the first sound generation control device, and a time difference between the first sound generation instruction and the second sound generation instruction measured by the on-on time timer device is less than a double stop judgment time having a predetermined time duration.

In the electronic musical instrument in accordance with a first aspect of the embodiment of the invention, the switching device may switch such that, after a musical sound whose sound generation is instructed by the sound generation instruction inputted by the input device is switched to be controlled and generated by the second sound generation control device, and when the number of sound generation instructions to which corresponding sound stop instructions are not inputted becomes zero, a next musical sound whose sound generation is instructed by a sound generation instruction inputted by the input device is controlled and generated by the first sound generation control device.

In the electronic musical instrument in accordance with a second aspect of the embodiment of the invention, the switching device may switch such that, after a musical sound whose sound generation is instructed by the sound generation instruction inputted by the input device is switched to be controlled and generated by the second sound generation control device, and when the number of sound generation instructions to which corresponding sound stop instructions are not inputted becomes one, a next musical sound whose sound generation is instructed by a sound generation instruction inputted by the input device is controlled and generated by the first sound generation control device.

The electronic musical instrument in accordance with a third aspect of the embodiment of the invention further includes:

a gate time timer device that measures a time difference between a sound generation instruction inputted by the input device and a stop instruction that instructs to stop a musical sound generated in response to the sound generation instruction; and a mistouch correction device that, when the switching device has switched such that the second sound generation control device controls and generates a musical sound whose sound generation is instructed by the first sound generation instruction and a musical sound whose sound generation is instructed by the second sound generation instruction inputted next to the first sound generation instruction, a stop instruction is then inputted to instruct to stop the musical sound generated by the first sound generation instruction, and a time difference between the first sound generation instruction and the stop instruction measured by the gate time timer device is within a mistouch judgment time having a predetermined time duration, stops the musical sound generated by the first sound generation instruction, and assign parts among the predetermined number of parts which are not assigned to the musical sound whose sound generation is instructed by the second sound generation instruction to the musical sound whose sound generation is instructed by the second sound generation instruction thereby starting generation of the musical sound which is thereafter controlled by the first sound generation control device.

According to the electronic musical instrument of the embodiment of the invention described above, a performance in unison with an ample depth generated by the first sound generation control device can be switched to a chord performance that maintains a feeling of appropriateness of the number of performers generated by the second sound generation control device without special operations using switches or the like. Therefore, the embodiment can provide effects that create realistic performance with timbres which may be generated by the brass section that simultaneously plays sounds of multiple musical instruments, without artificial changes in the sound volume and abrupt sound discontinuity.

According to the electronic musical instrument of the first aspect of the embodiment, in addition to the effects provided by the electronic musical instrument of the embodiment described above, a chord performance that maintains a feeling of appropriateness of the number of performers generated by the second sound generation control device can be naturally switched to a performance in unison with an ample depth to be generated by the first sound generation control device.

According to the electronic musical instrument in accordance with the second aspect of the embodiment, in addition to the effects provided by the electronic musical instrument of the embodiment described above, a chord performance that maintains a feeling of appropriateness of the number of performers generated by the second sound generation control device can be naturally switched to a performance in unison with an ample depth to be generated by the first sound generation control device.

According to the electronic musical instrument of the third aspect of the embodiment, in addition to the effects provided by the electronic musical instrument of the embodiment described above, the following effect can be obtained. When adjacent keys are touched by mistake when playing a performance in unison with the depth by the first sound generation control device, the control may be changed to a control by the second sound generation control device, but immediately thereafter the control returns to the control by the first sound generation control device. Therefore unnatural changes in the sound volume would not occur, and a performance in unison with an ample depth by the first sound generation control device can be conducted in a manner as expected.

BRIEF DESCRIPTION OF THE DRAWINGS

FIGS. 2A and 2B are graphs for describing Unison 1, wherein FIG. 2A shows a key depression state, and FIG. 2B shows a state of musical sounds generated in response to the key depression indicated in FIG. 2A.

FIGS. 3A to 3D are graphs for describing Unison 2, wherein FIGS. 3A and 3C show key depression states, and FIGS. 3B and 3D show states of musical sounds generated in response to the key depressions indicated in FIGS. 3A and 3C, respectively.

FIG. 5A shows a key depression state, FIG. 5B shows a state of musical sounds without conducting a mistouch process, and FIG. 5C shows a state of musical sounds when a mistouch process is conducted.

FIG. 6A shows a key depression state, and FIG. 6B shows a state of musical sounds corresponding to the FIG. 6A.

FIG. 7A shows a key depression state, FIG. 7B shows a state of musical sounds without conducting a mis-legato process, and FIG. 7C shows a state when a mis-legato process is conducted.

FIG. 11A shows a key depression state, and FIG. 11B shows a state of musical sounds generated in response to the key depression shown in FIG. 11A.

FIG. 14A shows a key depression state, FIG. 14B shows a state of musical sounds when a delay time is not provided, and FIG. 14C shows a state of musical sounds when delay times are provided.

DESCRIPTION OF EXEMPLARY EMBODIMENTS

Figure 1:
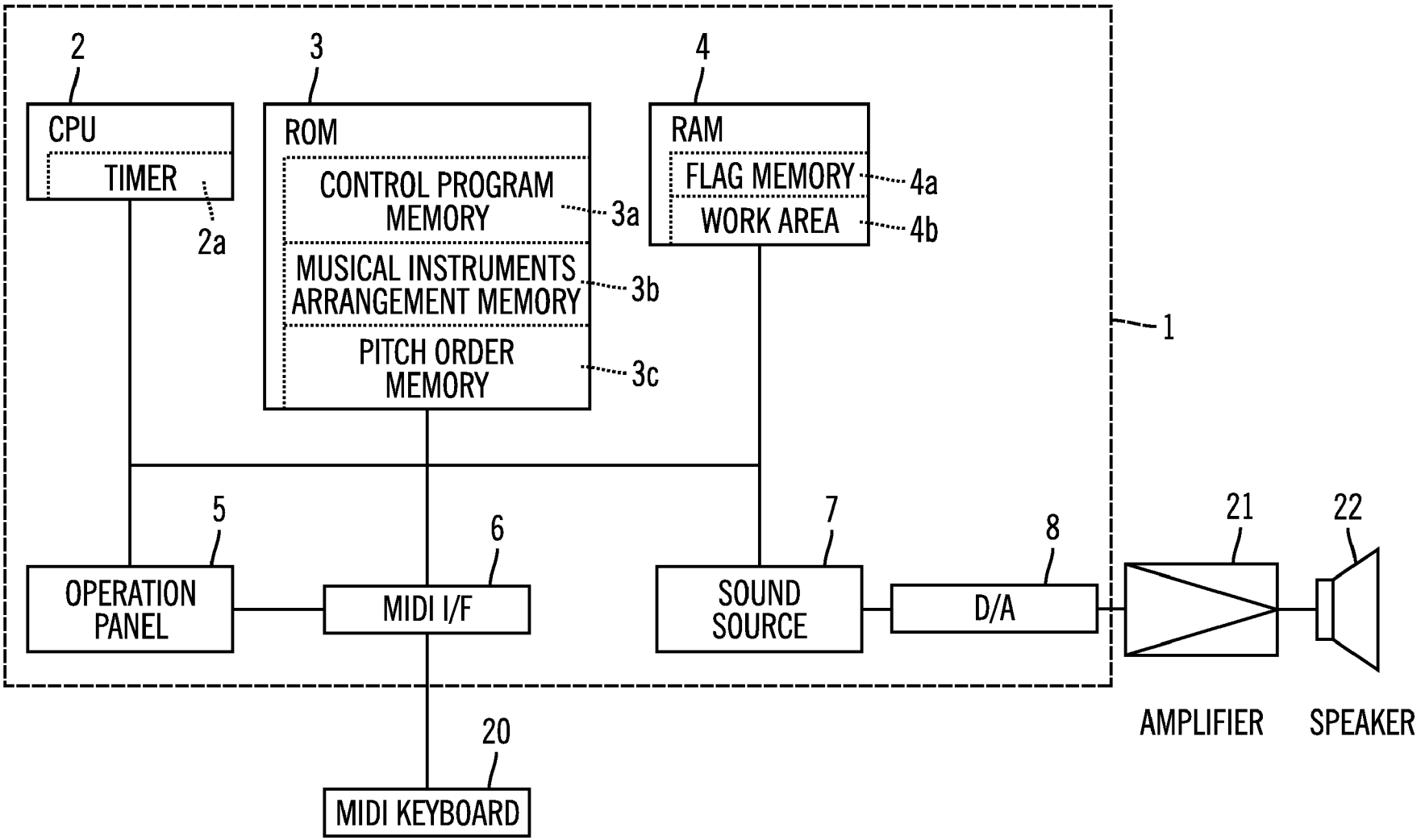
FIG. 1 is a block diagram of the electrical structure of an electronic musical instrument in accordance with a first embodiment of the invention.

A first preferred embodiment of the invention is described below with reference to the accompanying drawings. FIG. 1 is a block diagram of the electrical structure of an electronic musical instrument 1 in accordance with an embodiment of the invention. The electronic musical instrument 1 is capable of generating musical sounds with a plurality of timbres in response to each one of sound generation instructions.

As shown in FIG. 1, the electronic musical instrument 1 is primarily provided with a CPU 2, a ROM 3, a RAM 4, an operation panel 5, a MIDI interface 6, a sound source 7, and a D/A converter 8. The CPU 2, the ROM 3, the RAM 4, the operation panel 5, the MIDI interface 6 and the sound source 7 are mutually connected through a bus line.

An output of the sound source 7 is connected to the D/A converter 8, an output of the D/A converter 8 is connected to an amplifier 21 that is an external equipment, and an output of the amplifier 21 is connected to a speaker device 22 that is an external equipment. On the other hand, the MIDI interface 6 is connected to a MIDI keyboard 20 that is an external equipment.

The CPU 2 controls each of the sections of the electronic musical instrument 1 according to a control program 3*a* and fixed value data stored in the ROM 3. The CPU 2 includes a built-in timer 2*a* wherein the timer 2*a* counts clock signals generated by a clock signal generation circuit not shown, thereby measuring time. By the time measured by the timer 2*a*, an on-on time that is a time duration from an input of note-on information to an input of the next note-on information, and a gate time that is a time duration from an input of note-on information until an input of note-off information corresponding to the note-on information, and a sound generation continuation time that is a time elapsed from the time when note-on information is inputted thereby instructing the sound source 7 to start sound generation.

It is noted that the note-on information and the note-off information are information that are inputted by the MIDI keyboard 20 through the MIDI interface 6, and conform to the MIDI specification. Also, the note-on information and the note-off information may be generally referred to as note information.

Note-on information may be transmitted when a key of the MIDI keyboard 20 is depressed and instructs to start generation of a musical sound, and is composed of a status indicating that the information is note-on information, a note number indicating a pitch of the musical sound, and a note-on velocity indicating a key depression speed.

Also, note-off information may be transmitted when a key of the MIDI keyboard 20 is released and instructs to stop generation of a musical sound, and is composed of a status indicating that the information is note-off information, a note number indicating a pitch of the musical sound and a note-off velocity indicating a key releasing speed.

The ROM 3 is a read-only (non-rewritable) memory, and may include a control program memory 3*a* that stores a control program to be executed by the CPU 2, a musical instrument arrangement memory 3*b* that stores arrangements of musical instruments, and a pitch order memory 3*c*. The details of the control program stored in the control program memory 3*a* shall be described below with reference to flow charts shown in FIGS. 8 to 10.

The arrangements of musical instruments stored in the musical instrument arrangement memory 3*b* may include pre-set arrangements of multiple kinds of musical instruments for playing concerts, such as, for example, an orchestra that performs symphonies, sets of a musical instrument and an orchestra that perform concertos (piano concertos and violin concertos, for example), ensembles for string instruments or wind and brass instruments, big bands, small-sized combos and the like. These pre-set arrangements can be selected by the performer. It is noted that the arrangements of musical instruments may be stored in advance in the ROM 3, but may be arbitrarily modified by using operation members and stored in the RAM 4.

The pitch order memory 3*c* stores the pitch order defining the order of pitches of plural timbres that can be generated by the sound source 7. For example, in the case of wind and brass instruments, the order of the instruments from higher to lower pitch, namely, flute, trumpet, alto saxophone and trombone are stored. When the mode is set to a unison mode, timbres assigned to the respective parts are assigned to an inputted note according to this pitch order. It is noted that the pitch order may be stored in advance in the ROM 3, but may be arbitrarily modified by using operation members and may be stored in the RAM 4.

The RAM 4 is a rewritable memory, and includes a flag memory 4*a* for storing flags and a work area 4*b* for temporarily storing various data when the CPU 2 executes the control program stored in the ROM 3. The flag memory 4*a* stores mode flags. The mode flags are flags that indicate if the performance mode to assign parts to each note in the electronic musical instrument 1 is Unison 1 mode or Unison 2 mode. Unison 1 mode and Unison 2 mode shall be described below.

The work area 4*b* stores the time at which note-on information is inputted, corresponding to a note number indicated by the note-on information. The stored time is referred to when the next note-on information is inputted, whereby an on-on time that is a time difference between the note-on information obtained now and the note-on information inputted immediately before is obtained, and Unison 1 mode or Unison 2 mode is set according to the value of the on-on time.

The time of inputting the note-on information is also referred to when note-off information is inputted, whereby a gate time that is a time duration from the time of inputting the note-on information to the time when note-off information having the same note number as the note number of the note-on information is inputted is obtained. When the gate time is shorter than a predetermined time, processes such as a process to judge whether a mistouch occurred or not are executed.

Also, the work area 4*b* is provided with a note map. The note map stores note flags and reassignment flags for note numbers, respectively. The note flag is a flag that indicates if sound generation is taking place or not. When an instruction to start sound generation is given to the sound source 7, the note flag is set to 1, and when an instruction to stop sound generation is given, the note flag is set to 0.

Also, the reassignment flag is set, in Unison 2 mode, to 1 for note numbers when their associated parts are to be reassigned, and to 0 when the reassignment process is completed. When parts are assigned to a note number, part numbers indicating the assigned parts are stored corresponding to the note number.

The operation panel 5 is provided with a plurality of operation members to be operated by the performer, and a display device that displays parameters set by the operation members and the status according to each performance.

As the main operation members, a mode switch for switching between polyphonic mode and unison mode, a timbre selection switch for selecting timbres in the polyphonic mode, and an arrangement setting operation member for selecting or setting arrangements of musical instruments may be provided.

The polyphonic mode is a mode for generating musical sounds in a single timbre, whereby musical sound in a single timbre selected by the timbre selection switch is generated in response to each note-on information inputted through the MIDI keyboard 20.

The unison mode is a mode for generating musical sounds with a plurality of timbres, whereby musical sound in one or a plurality of timbres in the arrangement of musical instrument set by the arrangement setting operation member is generated in response to each note-on information inputted through the MIDI keyboard 20. The unison mode includes unison 1 mode (hereafter simply referred to as "Unison 1") and unison 2 mode (hereafter simply referred to as "Unison 2").

The MIDI interface 6 is an interface that enables communications of MIDI information that conforms to the MIDI standard, and a USB interface may also be used in recent years. The MIDI interface 6 is connected to the MIDI keyboard 20, wherein note-on information, note-off information and the like are inputted through the MIDI keyboard 20, and the inputted MIDI information is stored in the work area 4*b* of the RAM 4.

The MIDI keyboard 20 is provided with a plurality of white keys and black keys. When any of the keys are depressed, the MIDI keyboard 20 outputs note-on information corresponding to the depressed keys, and when the keys are released, the MIDI keyboard 20 outputs note-off information corresponding to the released keys.

The sound source 7 stores musical sound waveforms of a plurality of timbres of a variety of musical instruments, such as, a piano, a trumpet and the like, reads specified ones of the stored musical sound waveforms according to information sent from the CPU 2 instructing to start generation of musical sounds, and generates the musical sounds with a pitch, a volume and a timbre according to the instruction. Musical sound signals outputted from the sound source 7 are converted to analog signals by the D/A converter 8, and outputted.

The D/A converter 8 connects to an amplifier 21. The analog signal converted by the D/A converter 8 is amplified by the amplifier 21, and outputted as a musical sound from a speaker system 22 connected to the amplifier 21.

Next, referring to FIG. 2, Unison 1 is described. FIG. 2 shows a graph for describing Unison 1. Unison 1 is a mode in which, when one of the keys is depressed, musical sounds of predetermined plural parts are generated at a pitch designated by the key depressed, and monophonic operation is executed with last-note priority. In this mode, a profound monophonic unison performance by plural parts can be played.

In an example to be described below, the musical instrument arrangement is compose of trumpet assigned to Part 1, clarinet assigned to Part 2, alto saxophone assigned to Part 3 and trombone assigned to Part 4, and the pitch order is set in a manner that Part 1, Part 2, Part 3 and Part 4 are set in this order from higher pitch.

Figure 2A:
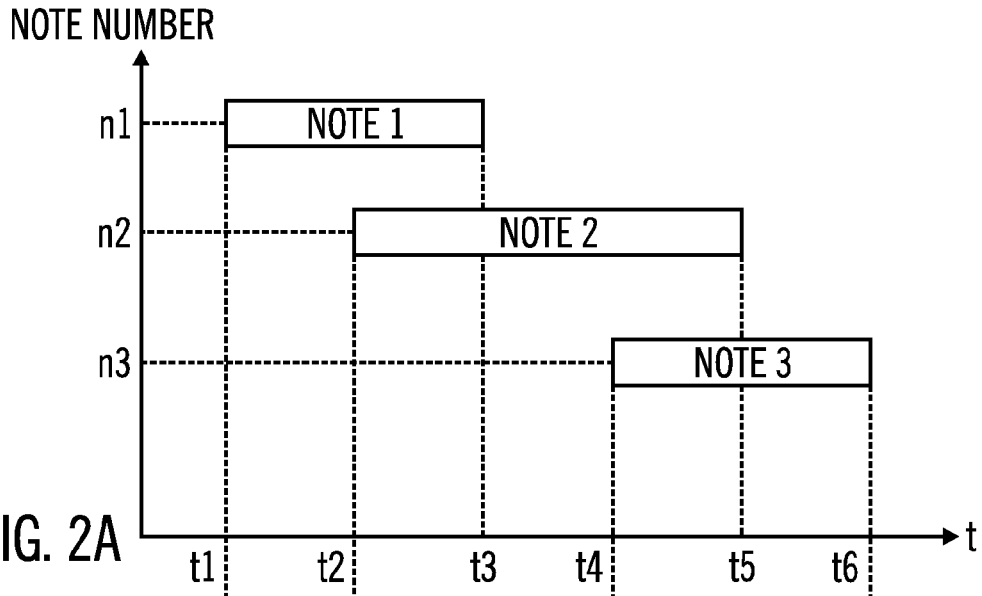
Figure 2B:
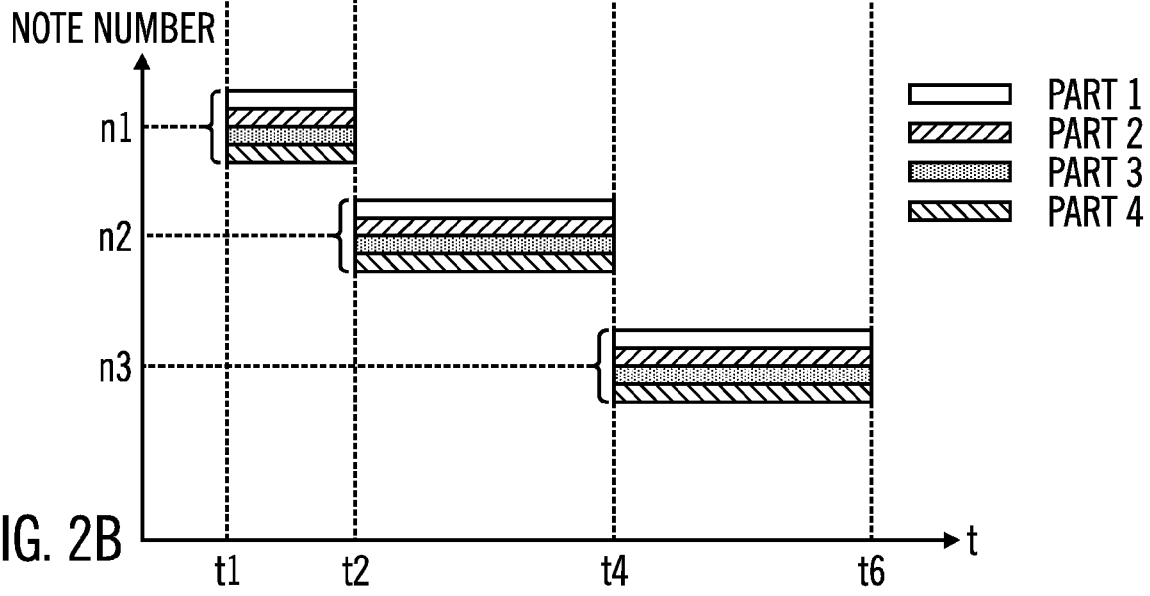

FIG. 2A is a graph showing a key depression state, and FIG. 2B is a graph showing a state of musical sounds to be generated by the key depression shown in FIG. 2A. In FIGS. 2A and 2B, the time elapsed is plotted on the axis of abscissas and pitches (note numbers) are plotted on the axis of ordinates. FIG. 2A shows that note-on information of Note 1 at pitch n1 is inputted at time t1, note-on information of Note 2 at pitch n2 is inputted at time t2, note-on information of Note 3 at pitch n3 is inputted at time t4, note-off information of Note 1 is inputted at time t3, note-off information of Note 2 is inputted at time t5, and note-off information of Note 3 is inputted at time t6.

As indicated above, the note-on information is information indicating that a key is depressed, and the note-off information is information indicating that the depressed key is released. For example, a key corresponding to Note 1 is depressed at time t1 and is kept depressed until it is released at time t3. FIG. 2A therefore shows the time duration in which each of the keys is depressed by a rectangular box extending along the axis of abscissas.

FIG. 2B shows the generated musical sound for each of the parts from its start to stop by a rectangular box extending along the axis of abscissas, wherein Part 1 is shown by a rectangular box without hatching, Part 2 is shown by a rectangular box with diagonal lines extending from upper-right to lower-left side, Part 3 is shown by a rectangular box with multiple small dots, and Part 4 is shown by a rectangular box with diagonal lines extending from upper-left to lower-right side.

As indicated in FIG. 2B, generation of musical sounds of Parts 1-4 at pitch n1 are simultaneously started at time t1, the sound generation is stopped and generation of musical sounds of Parts 1-4 at pitch n2 is simultaneously started at time t2, the sound generation is stopped and generation of musical sounds of Parts 1-4 at pitch n3 is simultaneously started at time t4, and the sound generation is stopped at time t6.

In this manner, in Unison 1, the timbres corresponding to all the musical instruments set in the musical instrument arrangement are simultaneously generated at the same pitch in response to each sound generation instruction, and operated in a monophonic manner with a last-note-priority.

Figures 3A, 3B, 3C, 3D:
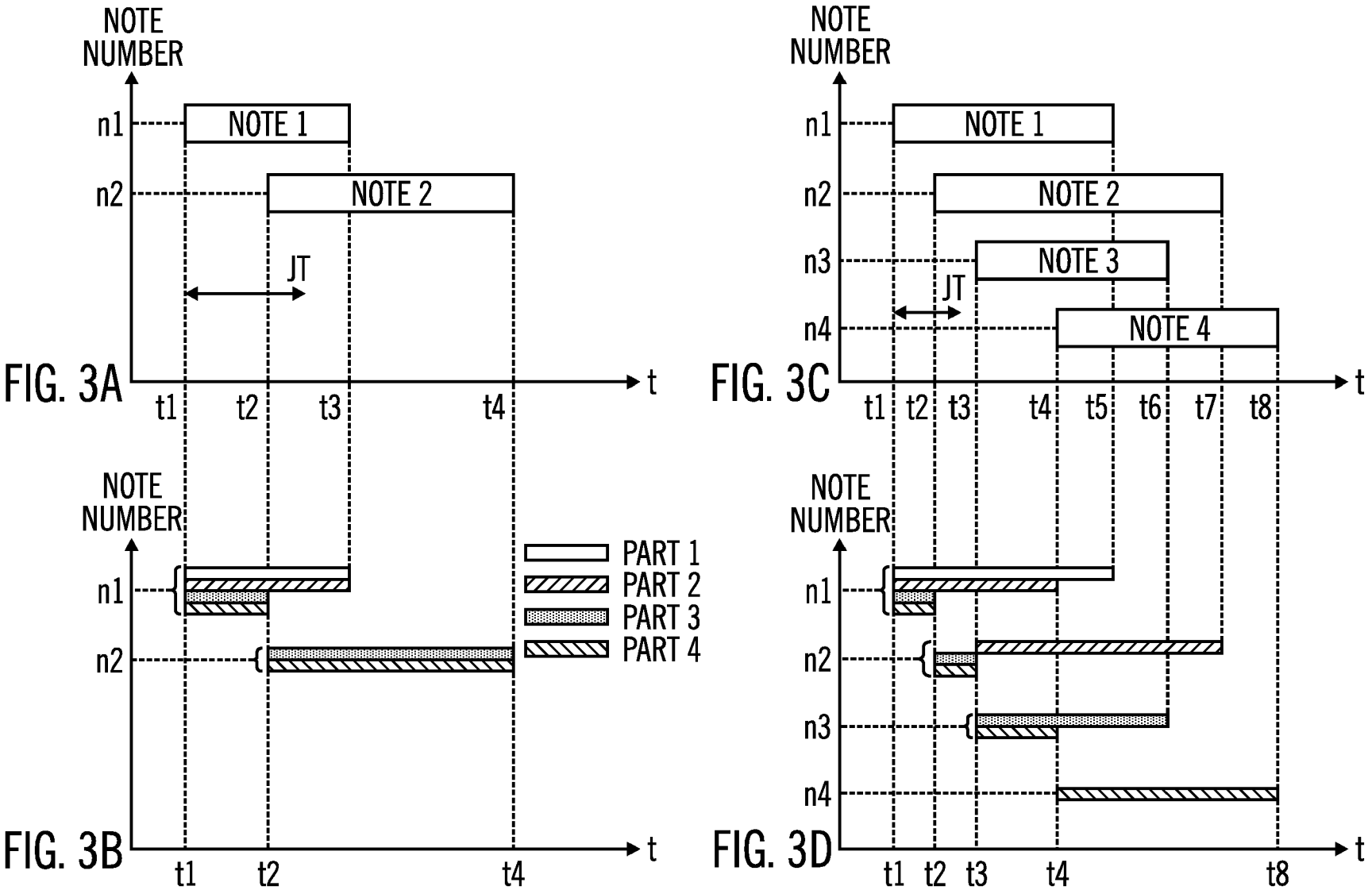

Next, referring to FIGS. 3A-3D and FIGS. 4A-4F, a method for switching between Unison 1 and Unison 2 is described. Like FIGS. 2A and 2B, FIG. 3A shows a key depression state and FIG. 3B shows a state of musical sounds corresponding to the key depression state shown in FIG. 3A. FIG. 3A indicates that note-on information of Note 1 at pitch n1 is inputted at time t1, note-on information of Note 2 at pitch n2 is inputted at time t2, note-off information of Note 1 is inputted at time t3, and note-off information of Note 2 is inputted at time t4. FIG. 3A also shows that pitch n1 of Note 1 is higher than pitch n2 of Note 2, and the on-on time that is a time difference between time t1 and time t2 is within a double stop judgment time JT. The double stop judgment time JT may be set, for example, at 50 msec. When the on-on time is within the double stop judgment time JT as in the example shown above, the mode is changed from Unison 1 to Unison 2.

As shown in FIG. 3B, when note-on information of Note 1 is inputted at time t1, sound generation of the four parts is simultaneously started at pitch n1, as the mode is Unison 1. Next, when note-on information of Note 2 at pitch n2 is inputted at time t2, the mode is switched to Unison 2 because the on-on time is within the double stop judgment time JT. In Unison 2, the plural parts composing the musical instrument arrangement are generally equally assigned to each of the notes being played by key depression according to the pitch order.

More specifically, among the four parts that are generating musical sounds at pitch n1, Part 1 (with the timbre being trumpet) and Part 2 (with the timbre being clarinet) which are higher in the pitch order continue generating the musical sound at pitch n1, and Part 3 (with the timbre being alto saxophone) and Part 4 (with the timbre being trombone) which are lower in the pitch order stop the sound generation at pitch n1, and start sound generation at pitch n2.

When note-off information of Note 1 is inputted at time t3, the musical sound of Part 1 and Part 2 being generated at pitch n1 is stopped, and when note-off information of Note 2 is inputted at time t4, the musical sound of Part 3 and Part 4 being generated at pitch n2 is stopped.

When the on-on time is within the double stop judgment time JT while the mode is in Unison 1, the mode is set to Unison 2, and the plural parts are divided, and assigned to a plurality of notes. Once the mode is set to Unison 2, the mode of Unison 2 is maintained thereafter irrespective to the on-on time, and the mode is switched to Unison 1 when all of the keys of the keyboard are released. It is noted that, as another method of switching Unison 2 to Unison 1, after the number of depressed keys becomes to be one in Unison 2 mode, the mode may be switched to Unison 1 at the next input of note-on information.

FIGS. 3A and 3B show the case where note-on information at pitch n1 is first inputted, and then note-on information at pitch n2 that is a lower pitch than pitch n1 is inputted. However, in the case where pitch n2 is higher than pitch n1, when note-on information at pitch n2 is inputted, Part 1 (with the timbre being trumpet) and Part 2 (with the timbre being clarinet) whose pitch order is higher among the four parts stop the ongoing sound generation and start sound generation at pitch n2, and Part 3 (with the timbre being alto saxophone) and Part 4 (with the timber being trombone) continue generating the musical sound at pitch n1.

FIGS. 3C and 3D indicate the case where four note-on information sets are sequentially inputted, where FIG. 3C is a graph showing a key depression state, and FIG. 3D is a graph showing a state of musical sounds corresponding to the key depression state shown in FIG. 3C.

FIG. 3C shows the case where note-on information of Note 1 at pitch n1 is inputted at time t1, note-on information of Note 2 at pitch n2 lower than that of Note 1 is inputted at time t2, note-on information of Note 3 at pitch n3 lower than that of Note 2 is inputted at time t3, and note-on information of Note 4 at pitch n4 lower than that of Note 3 is inputted at time t4; and note-off information of Note 1 is inputted at time t5, note-off information of Note 3 is inputted at time t6, note-off information of Note 2 is inputted at time t7, and note-off information of Note 4 is inputted at time t8. In this example, it is assumed that the on-on time between Note 1 and Note 2 which is a time difference between time t1 and time t2 is within the double stop judgment time JT.

In this case, as shown in FIG. 3D, when the note-on information of Note 1 is inputted at time t1, the four parts simultaneously start sound generation at pitch n1. When the note-on information of Note 2 at pitch n2 is inputted next at time t2, the mode is switched to Unison 2 because the on-on time between Note 1 and Note 2 is within the double stop judgment time JT, whereby, among the four parts that are generating musical sounds at pitch n1, Part 1 (with the timbre being trumpet) and Part 2 (with the timbre being clarinet) which are higher in the pitch order continue generating the musical sounds at pitch n1, and Part 3 (with the timbre being alto saxophone) and Part 4 (with the timbre being trombone) which are lower in the pitch order stop the sound generation at pitch n1, and start sound generation at pitch n2.

Next, the note-on information of Note 3 at pitch n3 is inputted at time t3. At this moment, note-off information of Note 1 and Note 2 has not been inputted, such that the mode is maintained in Unison 2 without regard to the on-on time between Note 2 and Note 3, Part 1 (with the timbre being trumpet) that is generating sound at pitch n1 continues the sound generation, Part 2 (with the timbre being clarinet) stops the sound generation and starts sound generation at pitch n2, and Part 3 (with the timbre being alto saxophone) and Part 4 (with the timber being trombone) that are generating the sound at pitch n2 stop the sound generation at pitch n2, and start sound generation at pitch n3.

Next, the note-on information of Note 4 at pitch n4 is inputted at time t4. At this moment, the mode is also maintained in Unison 2 without regard to the on-on time between Note 3 and Note 4; Part 1 (with the timbre being trumpet), Part 2 (with the timbre being clarinet) and Part 3 (with the timbre being alto saxophone) continue the sound generation; and Part 4 (with the timbre being trombone) that is generating the sound at pitch n3 stops the sound generation at pitch n3, and starts sound generation at pitch n4.

Next, referring to FIGS. 4A-4F, manners of assigning parts to notes in Unison 2 are described in detail. FIGS. 4A-4F show cases where the musical instrument arrangement includes four parts, and show manners of assigning the four parts to depressed keys (notes) when multiple keys are depressed. The pitch order is set in a manner that Part 1, Part 2, Part 3 and Part 4 are successively set in this order from higher to lower pitch.

Figure 4A:
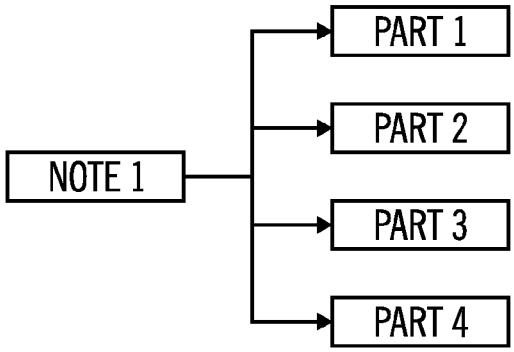
FIGS. 4A-4F schematically show methods of assigning parts to notes in Unison 2.
Figure 4B:
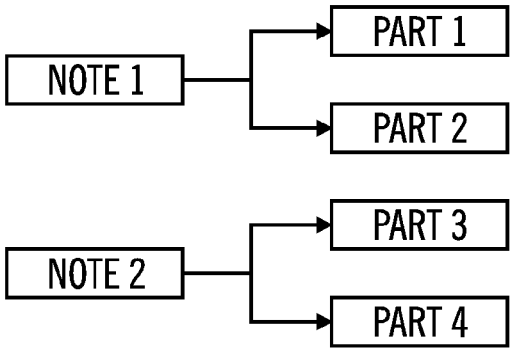

First, FIG. 4A indicates a case where Note 1 only is depressed, and the four parts are assigned to Note 1. FIG. 4B indicates a case where, in addition to Note 1, Note 2 with a lower pitch than Note 1 is also depressed, wherein Part 1 and Part 2 are assigned to Note 1, and Part 3 and Part 4 are assigned to Note 2, like the case shown in FIGS. 3A and 3B.

Figure 4C:
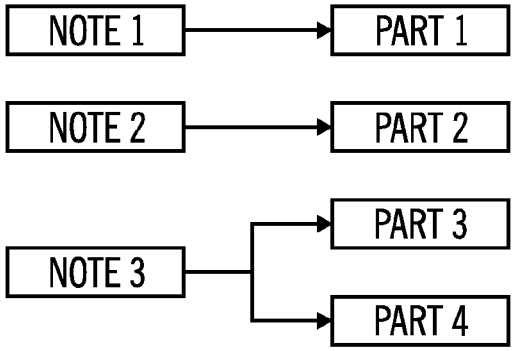

FIG. 4C indicates a case where, in addition to Note 1 and Note 2, Note 3 with a lower pitch than Note 2 is also depressed, wherein Part 1 is assigned to Note 1, Part 2 is assigned to Note 2, and Part 3 and Part 4 are assigned to Note 3. In the example shown in FIG. 4C, two parts are assigned to Note 3. However, instead, Part 1 and Part 2 may be assigned to Note 1, Part 3 to Note 2, and Part 4 to Note 3, or Part 1 may be assigned to Note 1, Part 2 and Part 3 to Note 2, and Part 4 to Note 3.

Figure 4D:
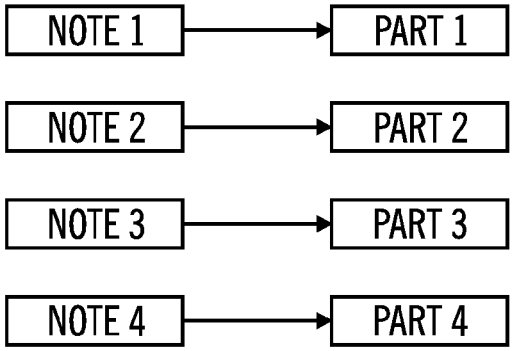

FIG. 4D shows a case where the number of notes and the number of parts are the same; and where, in addition to Note 1-Note 3, Note 4 with a lower pitch than Note 3 is depressed, wherein Part 1 is assigned to Note 1, Part 2 is assigned to Note 2, Part 3 is assigned to Note 3, and Part 4 is assigned to Note 4.

Figure 4E:
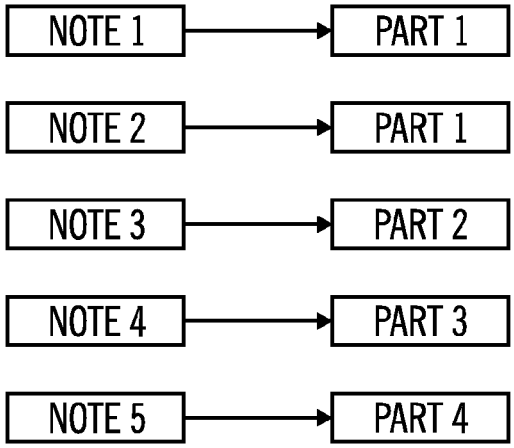
Figure 4F:
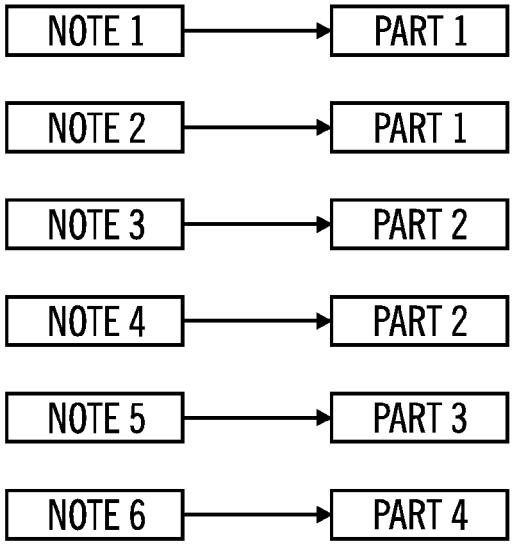

FIGS. 4E and 4F are figures for describing assignment methods used when the number of depressed keys (number of notes) is greater than the number of parts. FIG. 4E indicates a case where, in addition to Notes 1-4, Note 5 with a lower pitch than Note 4 is depressed, wherein Part 1 is assigned to Note 1 and Note 2, Part 2 is assigned to Note 3, Part 3 is assigned to Note 4, and Part 4 is assigned to Note 5.

FIG. 4F indicates a case where, in addition to Notes 1-5, Note 6 with a lower pitch than Note 5 is depressed, wherein Part 1 is assigned to Note 1 and Note 2, Part 2 is assigned to Note 3 and Note 4, Part 3 is assigned to Note 5, and Part 4 is assigned to Note 6.

In this manner, in Unison 2, plural parts are generally equally assigned to key-depressed notes according to the pitch order. For this reason, the number of parts that generate sounds does not drastically increase depending on the number of depressed keys, whereby musical sounds with a constant depth can be obtained. Even when the number of notes increases more than the number of parts, the key depression is not ignored, and optimum ones of the parts generate musical sounds without the sound generation being biased to particular ones of the musical instruments, balanced musical tones according to the pitch order can be obtained.

Next, the mechanism of generally equally assigning parts to notes in key-depression (hereafter referred to as key-depressed notes) according to the pitch order in Unison 2 is described.

When the number of key-depressed notes is smaller than or equal to ( < or =) the number of parts, the number of parts to be assigned (PartCnt) to each of the key-depressed notes is obtained. When the integer quotient of "the number of parts—the number of notes" is a, and the remainder is b, PartCnt for b number of the notes may be set to "a+1" and PartCnt for the other notes may be set to a. Concretely, for example, among key-depressed notes, PartCnt for the notes from highest in pitch to b-th note is set to "a+1" and PartCnt for the other notes is set to a. Alternatively, among key-depressed notes, PartCnt for the notes from lowest in pitch to b-th note may be set to "a+1" and PartCnt for the other notes may be set to a. Alternatively, without regard to the pitch, PartCnt for the notes up to b-th note randomly selected without repetition may be set to "a+1" and PartCnt for the other notes may be set to a. When PartCnt for each of the notes is decided, PartCnt for the parts from higher to lower in the pitch order are successively assigned to the notes from higher to lower pitch, respectively. It is noted that each of the parts may be assigned only once.

When the number of key-depressed notes is greater than ( >) the number of parts, the number of possible assignments (AssignCnt) for each of the parts is obtained. When the integer quotient of "the number of notes—the number of parts" is a, and the remainder is b, AssignCnt for b number of the parts may be set to "a+1" and AssignCnt for the other parts may be set to a. Concretely, for example, AssignCnt for the parts from highest in the pitch order to b-th part among the parts is set to "a+1" and AssignCnt for the other parts is set to a. Alternatively, AssignCnt for the parts from lowest in the pitch order to b-th part among the parts may be set to "a+1" and AssignCnt for the other parts may be set to a. Alternatively, without regard to the pitch, AssignCnt for the parts up to b-th part randomly selected without repetition may be set to "a+1" and AssignCnt for the other parts may be set to a. When AssignCnt for each of the parts is decided, one of the parts is assigned to each one of the key-depressed notes. In this instance, a part highest in the pitch order is selected as a part to be assigned, and this part is successively assigned to the notes from higher to lower pitch. Each of the parts can be assigned AssignCnt times. When one of the parts is assigned AssignCnt times, a part next highest in the pitch order is selected as a part to be assigned, and this part is assigned AssignCnt times.

In this manner, the parts can be generally equally assigned to each of the key-depressed notes with good balance, regardless of the number of notes or the number of parts.

Figure 5A:
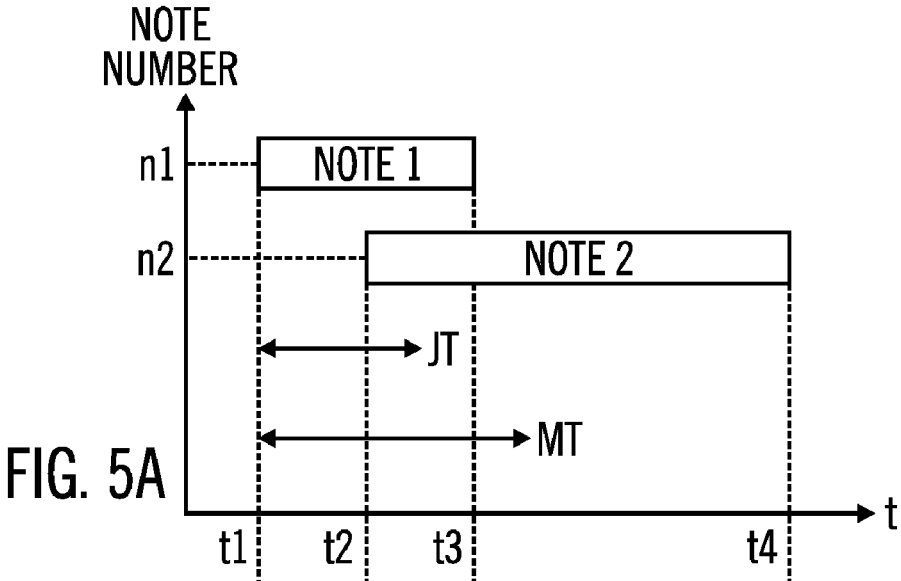
FIGS. 5A-5C are graphs for describing a mistouch process, where
Figure 5B:
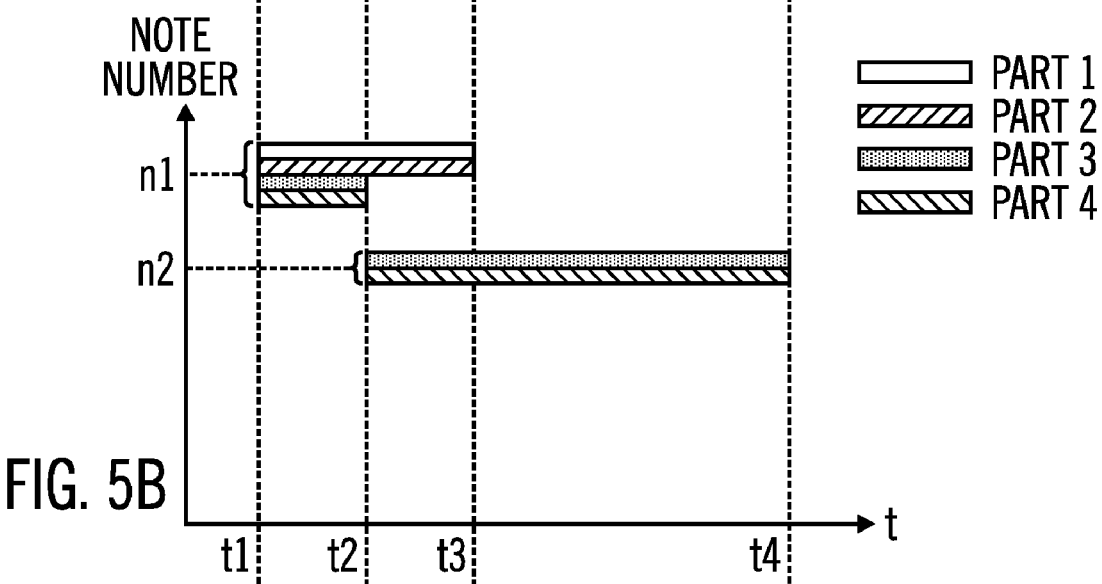
Figure 5C:
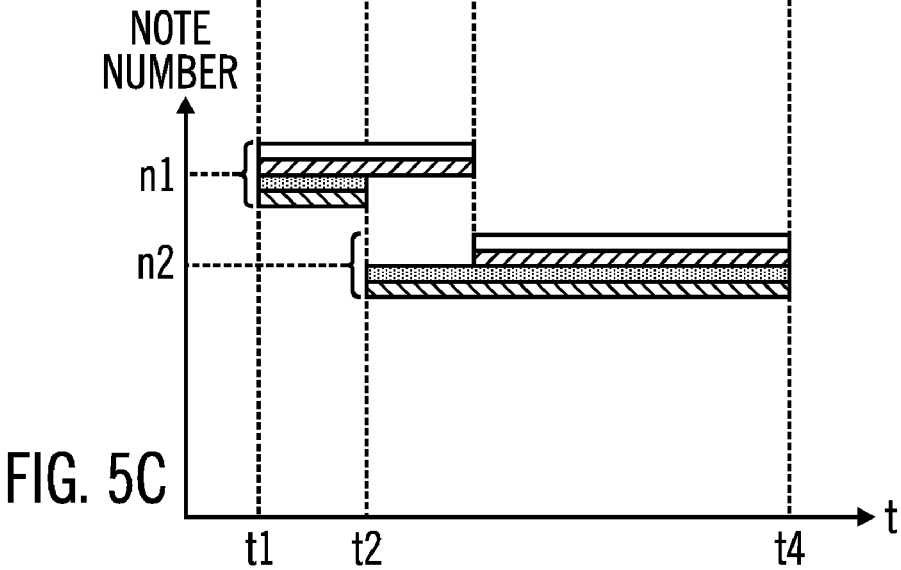

Next, referring to FIGS. 5A-5C, a mistouch process is described. The mistouch process is executed when a mistouch or a misplay in a performance occurs. A mistouch generally refers to a depression of a wrong key or keys. In this embodiment, a mistouch refers to an error depression of a key that is different from correct keys, wherein the time duration of the error depression is short.

FIG. 5A shows a case where note-on information of Note 1 at pitch n1 is first inputted, then in succession, note-on information of Note 2 at pitch n2 is inputted at time t2, and at time t3 immediately after time t2, note-off information of Note 1 is inputted. Here, it is assumed that the on-on time from time t1 to time t2 is within the double stop judgment time JT.

FIG. 5B shows a graph indicating a state of musical sounds generated by the sound source when the sets of note information are inputted as indicated in FIG. 5A, but a mistouch process is not executed. At the time t1, the mode is Unison 1, and sound generation of the four parts is started at pitch n1 in response to the note-on information of Note 1 at pitch n1. Then, when the note-on information of Note 2 at pitch n2 is inputted at time t2, the mode is changed to Unison 2 because the on-on time from time t1 to time t2 is within the double stop judgment time JT. Accordingly, among the four parts that are generating sound at pitch n1, Part 1 and Part 2 continue the sound generation at pitch n1, and Part 3 and Part 4 stop the sound generation at pitch n1 at time t2, and start sound generation at pitch n2.

When the note-off information of Note 1 is inputted immediately thereafter at time t3, Part 1 and Part 2 stop the sound generation at pitch n1. However, when the gate time of Note 1 is within a mistouch judgment time MT having a predetermined duration of time, Note 1 may be judged to be a mistouch, and sound generation by Part 1 and Part 2 stopped at time t3 may be restarted. The above process is referred to as a mistouch process. The mistouch judgment time MT may be set, for example, at 100 msec.

FIG. 5C is a graph showing a state of musical sounds generated by the sound source when a mistouch occurs and a mistouch process is executed. More specifically, at time t3, sound generated by Part 1 and Part 2 is started at pitch n2, and the mode is returned to Unison 1. By this process, even when the mode is shifted to Unison 2 due to a mistouch that is not intended, the mode can be immediately returned to Unison 1 that is intended by the performer. It is noted that the mistouch process may be executed in a condition where the gate time is within the mistouch judgment time MT. In addition, conditions where the number of depressed keys is reduced from two to one key, a pitch difference of the two keys is within 5 semitones, and/or an on-on time of the two keys is within the double stop judgment time JT may be used to judge the key operations as a mistouch. In accordance with the present embodiment, when all of the above conditions are met, the key operations are judged as a mistouch, and a mistouch process is executed.

An event of reducing the number of depressed keys from two to one is used as one of the conditions to judge the event as a mistouch. This is because such an event is a typical example of mistouch performance. Also, an event in which a pitch difference of two keys is within 5 semitones is used as one of the conditions to judge the event as a mistouch. This is because, when a key, which is separated from another key that is to be depressed, is depressed for a short time, such a key depression can be considered as an intended key depression, not a mistouch. Also, an event in which an on-on time of two keys is within the double stop judgment time JT is used as one of the conditions to judge the event as a mistouch. This is because, when an on-on time is longer than the double stop judgment time JT, such a key depression can be considered as an intended key depression, not a mistouch.

Figure 6A:
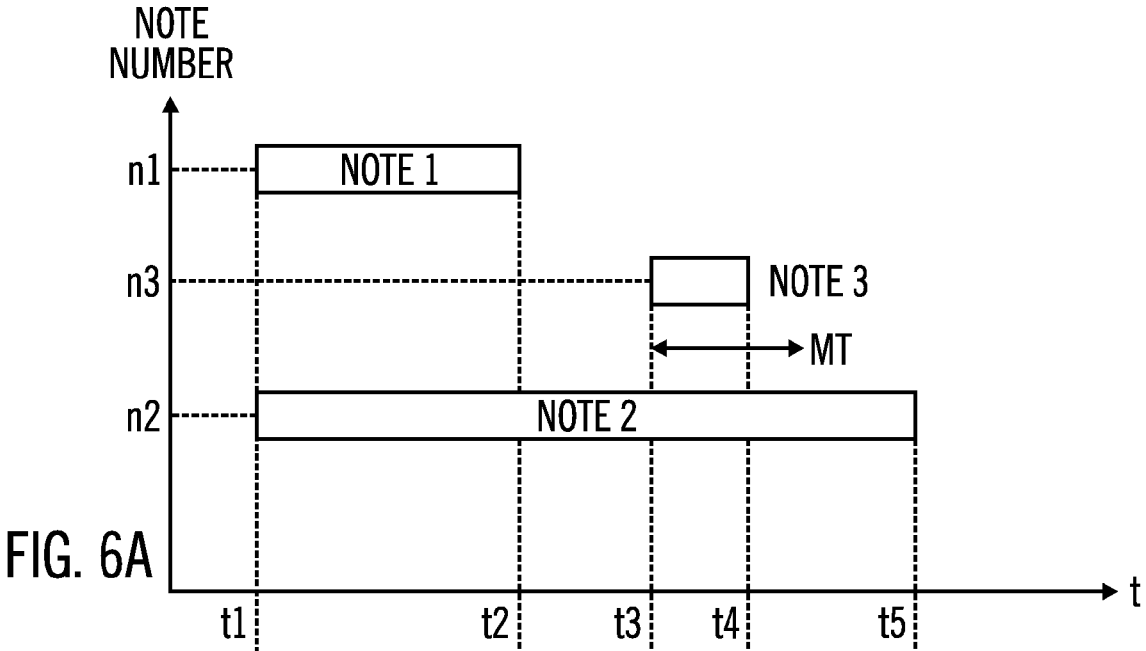
FIGS. 6A and 6B are graphs for describing the reason why an on-on time being within a double stop judgment time JT is used as a condition to judge itself as a mistouch, where
Figure 6B:
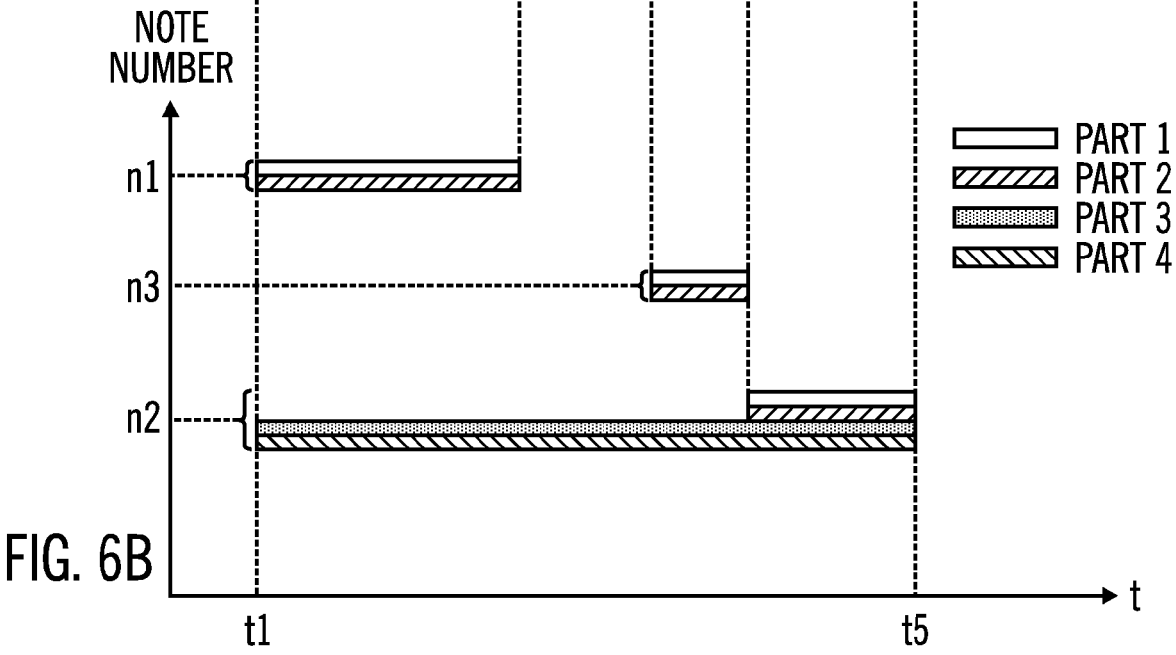

FIGS. 6A and 6B are graphs for describing the reason to use an event in which an on-on time is within the double stop judgment time JT as one of the conditions to judge the event as a mistouch. FIG. 6A is a graph indicating a key depression state, and FIG. 6B is a graph indicating a state of musical sounds corresponding to FIG. 6A. In this example, the mode is assumed to be Unison 2. As shown in FIG. 6A, note-on information of Note 1 at pitch n1 and note-on information of Note 2 at pitch n2 are inputted at time t1, and note-off information of Note 1 is inputted at time t2. A gate time of Note 1 which is a time duration from time t1 to time t2 is assumed to be longer than a mistouch judgment time MT. Then, note-on information of Note 3 at pitch n3 is inputted at time t3, and then note-off information of Note 3 is inputted at time t4. A gate time of Note 3 which is a time duration from time t3 to time t4 is assumed to be within the mistouch judgment time MT. Then, note-off information of Note 2 is inputted at time t5.

As shown in FIG. 6B, at time t1, sound generation by Part 1 and Part 2 at pitch n1 is started, and sound generation by Part 3 and Part 4 at pitch n2 is started. Then, the sound generation by Part 1 and Part 2 is stopped at time t2, and sound generation by Part 1 and Part 2 at pitch n3 is started at time t3. Then, at time t4, the sound generation by Part 1 and Part 2 is stopped. In this instance, the gate time of Note 3 is within the mistouch judgment time MT, and therefore, if the gate time is solely used as an object to be judged as a mistouch, Part 1 and Part 2 would restart sound generation at pitch n2 at time t4, as indicated in FIG. 6B. However, other note-on information is not inputted at any time near the time of input of the note-on information of Note 3, such that Note 3 would not be considered as a mistouch. Therefore, by using an event in which an on-on time is within the double stop judgment time JT as one of the conditions to judge the event as a mistouch, Note 3 is preferably judged not to be a mistouch, and Part 1 and Part 2 would not preferably start sound generation at time t4.

Also, even when the gate time of a note is within the mistouch judgment time MT, if note-off information of another note is imputed immediately before the time of input of note-off information of the note, the note may not preferably be judged as a mistouch. Such an event may occur when a staccatos performance in a chord is player, and a plurality of note-off information sets are inputted generally at the same time, which is not a mistouch. The time difference among the inputs of the multiple note-off information sets, which may be considered as being generally at the same time, may be, for example, 100 msec.

Next, a mis-legato process is described with reference to FIGS. 7A-7C. A legato technique is a performing method to play musical notes smoothly without intervening silence. In a musical performance with a keyboard instrument, a legato technique refers to a performing method of depressing a new key before releasing a key previously being depressed. Therefore, when note-on information of a next note is inputted before an input of note-off information of a previously key-depressed note, such an event may be considered that a legato performance is executed. Therefore, to differentiate an event of a legato performance from an event in which note-on information of a next note is inputted after note-off information of a previously key-depressed note is inputted, which is not a legato performance, modes of generating musical sounds may be made different from each other.

When the mode is Unison 2, and the legato performance is played, a problem may occur in which parts that should generate musical sounds are reduced. FIGS. 7A-7C are graphs for describing the problem that occurs when the legato performance is conducted, and a mis-legato process that is a countermeasure against the problem. FIG. 7A is a graph showing a key depression state, FIG. 7B is a graph showing a state of musical sounds corresponding to the key depression state in FIG. 7A when a mis-legato process is not executed, and FIG. 7C is a graph showing a state of musical sounds corresponding to the key depression state in FIG. 7A when a mis-legato process is executed.

Figures 7A, 7B, 7C:
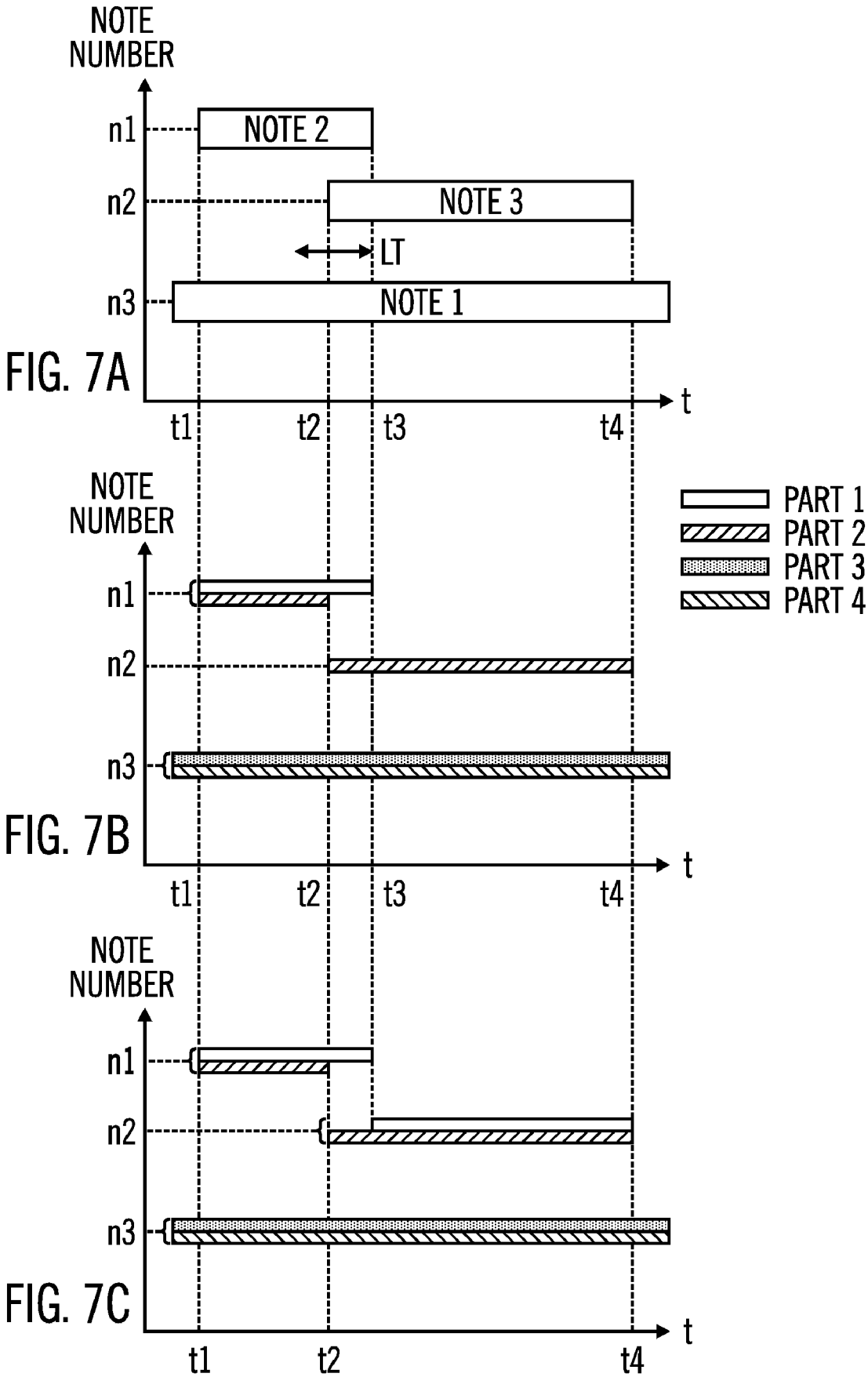
FIGS. 7A-7C are graphs for describing a mis-legato process, where

As shown in FIG. 7A, after Note 1 at pitch n3 is inputted, note-on information of Note 2 at pitch n1 being higher than pitch n3 is inputted at time t1, then note-on information of Note 3 at pitch n2 being lower than pitch n1 but higher than pitch n3 is inputted, and note-off information of Note 2 is inputted at time t3 that is immediately after time t2. The time from time t2 to time t3 is assumed to be within a mis-legato judgment time LT having a predetermined time duration. Then, note-off information of Note 3 is inputted at time t4. The mis-legato judgment time LT may be set, for example, at 60 msec.

In this case, it is assumed that the mode is Unison 2, and Part 3 and Part 4 are generating musical sound at pitch n3 in response to an input of note-on information of Note 1, as indicated in FIG. 7B. Then, when note-on information of Note 2 at pitch n1 is inputted at time t1, sound generation by Part 1 and Part 2 is started at pitch n1.

Next, when note-on information of Note 3 at pitch n2 is inputted at time t2, Part 1 highest in the pitch order continues the sound generation at pitch n1, and Part 2 lower in the pitch order stops the sound generation at pitch n1, and starts sound generation at pitch n2. When note-off information of Note 2 is inputted immediately thereafter at time t3, Part 1 stops the sound generation at pitch n1, and only Part 2 continues the sound generation at pitch n2. However, it can be considered that the performer plays the notes with a legato performance, and does not intend to reduce the number of parts that should generate musical sounds. Therefore, when the legato performance is executed in this manner, sound generation by Part 1 at pitch n2 may be restarted at time t3, as shown in FIG. 7C, such that the number of the parts generating the musical sounds would not be reduced. The process described above is called a mis-legato process. By this process, unintended sound thinning in a legato performance in Unison 2 mode can be prevented.

Figure 8:
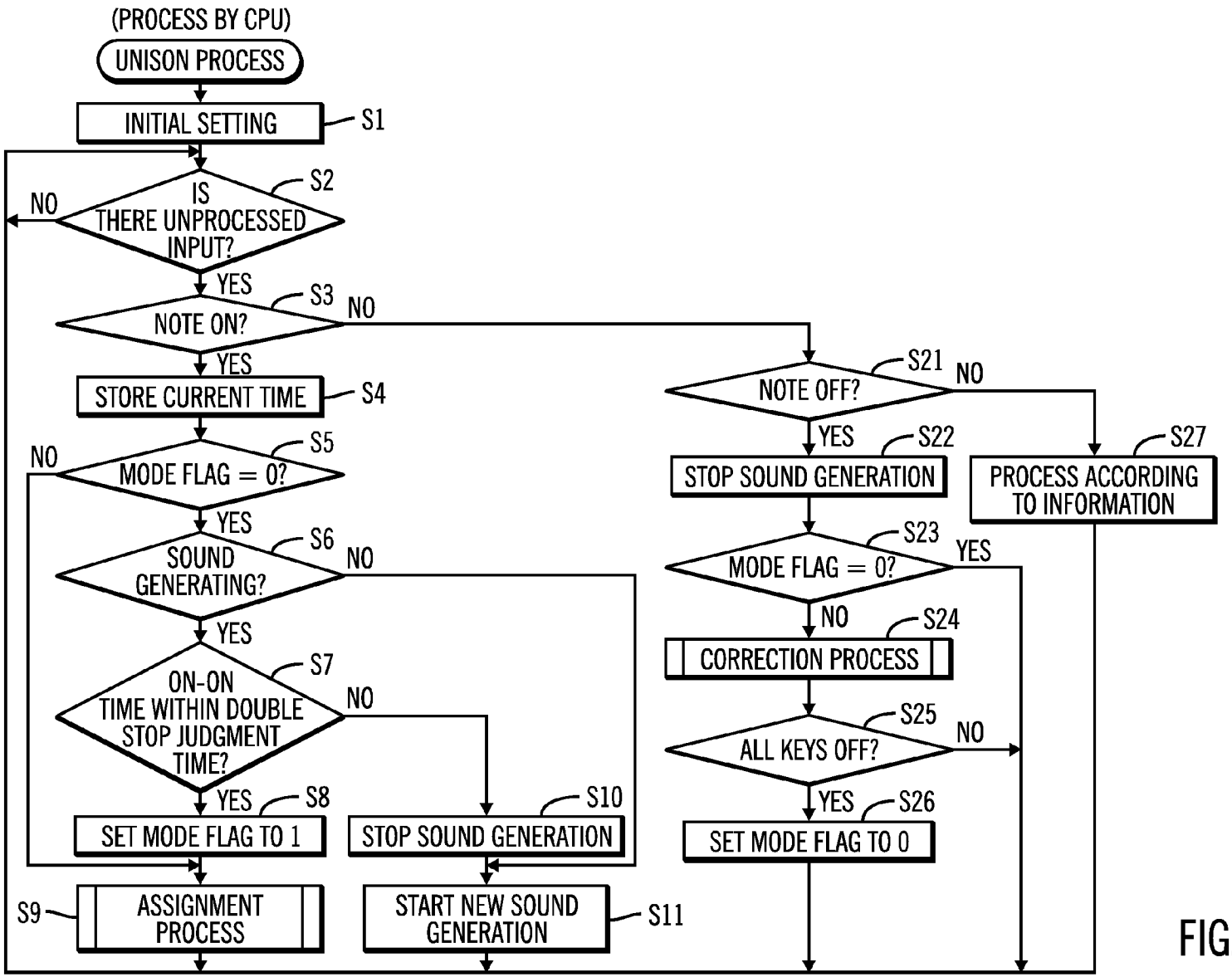
FIG. 8 is a flow chart showing a unison process.
Figure 9A:
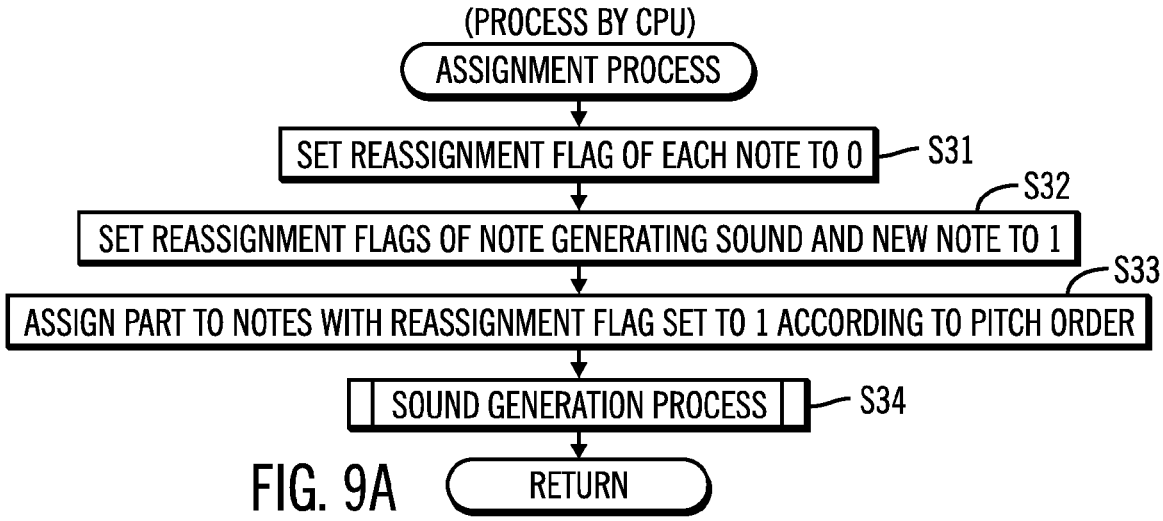
FIG. 9 is a flow chart showing an assigning process.
Figure 9B:
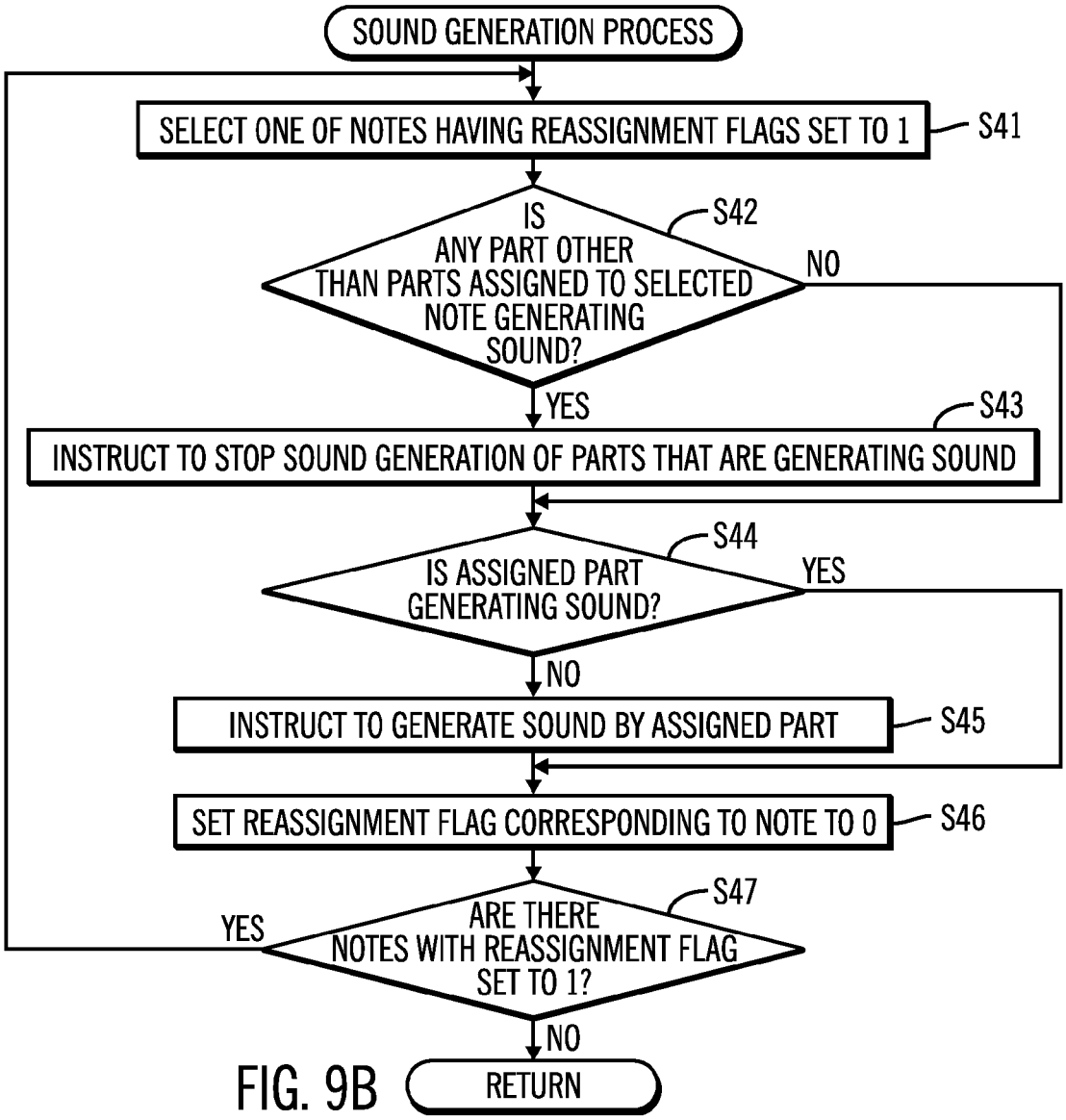
Figure 10:
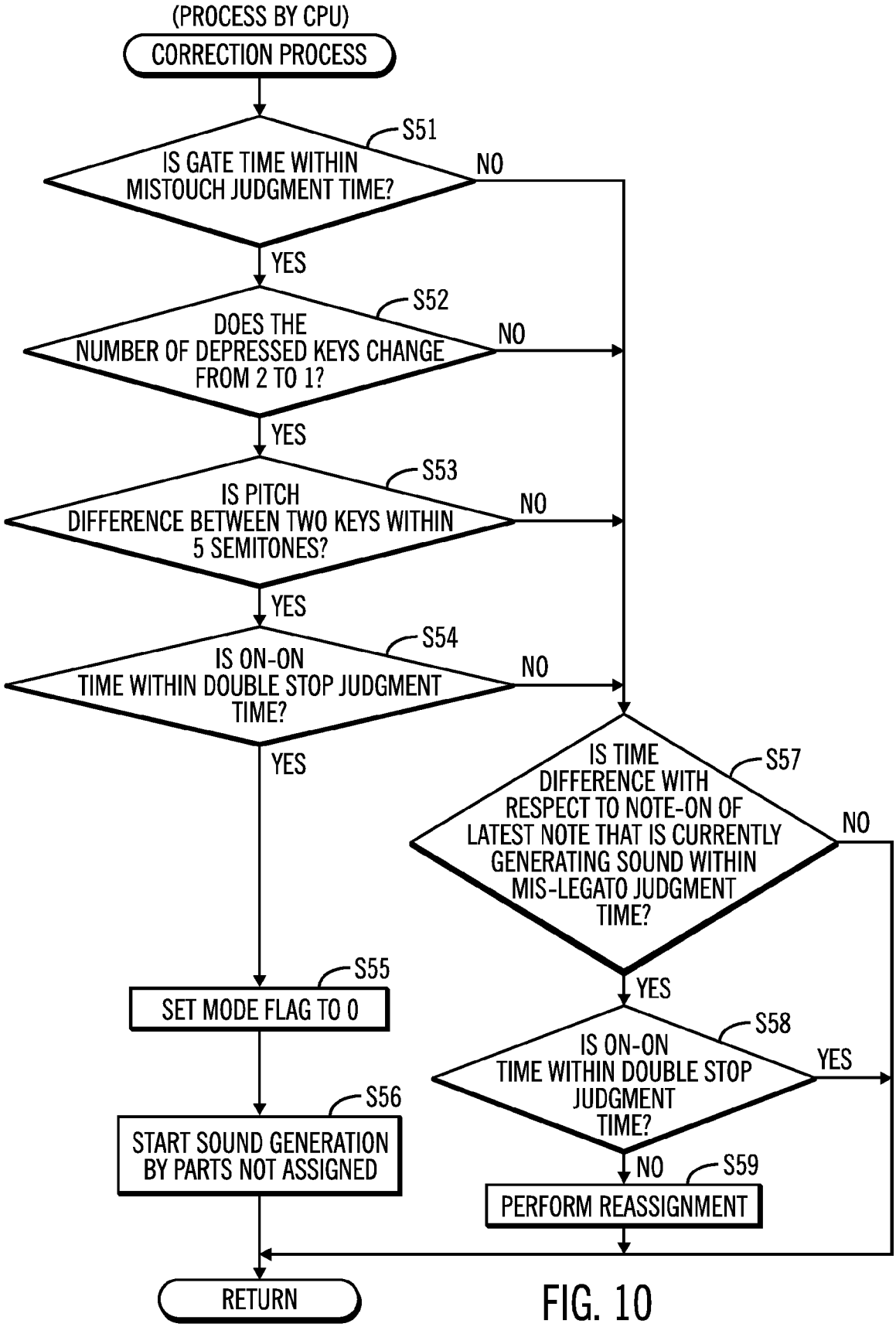
FIG. 10 is a flow chart showing a correction process.

Next, referring to flow charts of FIGS. 8-10, processes to be executed by the CPU 2 are described. First a unison process shown in FIG. 8 is described. FIG. 8 is a flow chart showing the unison process to be executed with the electronic musical instrument 1. The unison process is started when a unison mode is set, and repeatedly executed until the unison mode is stopped.

In the unison process, first, an initial setting is conducted (S1). As the initial setting, the mode flag stored in the flag memory 4*a* of the RAM 4 is set to 0, whereby setting the mode to Unison 1, and all the note flags stored in the note map are set to 0. Also, the timer 2*a* built in the CPU 2 is set to start time measurement.

Next, it is judged as to whether unprocessed MIDI information inputted in the MIDI interface remains (S2), and if unprocessed MIDI information remains (S2: Yes), whether the information is note-on information is judged (S3). If no unprocessed MIDI information remains (S2: No), the process waits until new MIDI information is inputted.

If the remaining information is note-on information (S3: Yes), the current time measured by the timer 2*a* is stored in the work area 4*b* corresponding to that note-on information (S4).

Next, it is judged as to whether the mode flag is set to 0 (S5), and if the mode flag is set to 0 (S5: Yes), whether the sound source 7 is generating any musical sound is judged (S6). This judgment can be done by referring to note flags stored in the note map that is stored in the work area 4*b*. In the note map, note flags are set corresponding to notes when start of sound generation is instructed to the sound source 7, and when stop of sound generation of notes is instructed, the corresponding note flags are reset.

If any of the musical sounds is being generated (S6: Yes), the time of input of note-on information immediately before is detected from the work area 4*b*, an on-on time that is a time difference with respect to the current time is calculated, and whether the on-on time is within a double stop judgment time JT is judged (S7). When the on-on time is within the double stop judgment time JT (S7: Yes), the mode flag is set to 1 (S8).

When it is judged in the judgment step S5 that the mode flag is not 0, but 1 (S5: No), or the step S8 is finished, an assignment process in Unison 2 is conducted (S9). The assignment step is described below with reference to FIG. 9. When the step S9 is finished, the process returns to the step S2.

When it is judged in the judgment step S7 that the on-on time is not within the double stop judgment time JT (S7: No), the mode is Unison 1, and an instruction is given to the sound source 7 to stop the musical sounds of all of the parts that are generating sounds (S10). This instruction is done by referring to the note map, and sending information to the sound source 7 to stop notes whose note flags are set to 1. Then the note flags are set to 0, and part numbers stored in association with the notes are cleared.

If it is judged in the judgment step S6 that no musical sound is being generated (S6: No), or the step S10 is finished, an instruction is given to the sound source 7 to start sound generation by all the parts in the musical instrument arrangement at pitches corresponding to the note numbers included in the inputted note-on information, and note flags corresponding to the note numbers in the note map are set to 1 (S11), and the process returns to the step S2.

On the other hand, when it is judged in the judgment step S3 that the MIDI information is not note-on information (S3: No), whether the information is note-off information is judged (S21). If the information is note-off information (S21: Yes), an instruction is given to the sound source 7 to stop generation of the musical sounds at pitches corresponding to the note numbers indicated by the note-off information, and note flags corresponding to the note numbers in the note map are set to 0, and part numbers stored corresponding to the notes are cleared (S22). Next, whether or not the mode flag is set to 0 is judged (S23), and if the mode flag is not set to 0 but set to 1 (S23: No), a correction process is conducted (S24). The correction process may be a mistouch process or a mislegato process, which are described below with reference to FIG. 10.

When the correction process S24 is finished, the note map is referred, and a judgment is made as to whether the entire note flags are set to 0 whereby all of the keys are released (S25). When all of the keys are released (S25: Yes), the mode flag is set to 0 (S26), and the process returns to the step S2. When it is judged in the judgment step S23 that the mode flag is 0 (S23: Yes), or it is judged in the judgment step S25 that any of the keys is not released (S25: No), the process returns to the step S2. It is noted that, in the judgment step S25, by referring to the note map, it may be judged as to whether the number of depressed keys is 1 (S25), and if the number of depressed keys is 1 (S25: Yes), the mode flag may be set to 0 (S26), and the process may be returned to the step S2.

In the judgment step S21, when the unprocessed information is not note-off information (S21: No), a process corresponding to the information is executed (S27), and the process returns to the step S2.

Next, referring to FIGS. 9A and 9B, an assignment process in Unison 2 is described. FIG. 9A is a flow chart indicating the assignment process, and FIG. 9B shows a sound generation process to be executed in the assignment process. In the assignment process, first, all reassignment flags stored in the note map corresponding to the respective note numbers are set to 0 as an initial setting (S31). Then, note flags stored in the note map are referred to, whereby reassignment flags corresponding to note numbers having note flags set to 1 and note numbers indicated by the latest note-on information are set to 1 (S32).

Then, to notes with reassignment flags being set to 1, parts are assigned according to note numbers of the notes and the pitch order of the parts (S33), as described above with reference to FIG. 4. By this processing, parts are reassigned to the notes that are generating sounds and new notes, and part numbers indicating the parts assigned to the note numbers of the notes in sound generation and the new notes are temporarily stored in the work area 4*b* of the RAM 4, and then a sound generation process is executed (S34). The sound generation process is a process shown in FIG. 9B. When the sound generation process is finished, the process returns to the unison process.

Next, the sound generation process is described with reference to FIG. 9B. FIG. 9B is a flow chart indicating the sound generation process. In the sound generation process, first, any one of the note numbers with reassignment flags set to 1 is selected (S41). Alternatively, the largest note number or the smallest note number may be selected. Next, it is judged as to whether any parts other than the parts assigned in the step S33 are generating sound for the selected note number (S42). This judgment may be done by comparing the parts temporarily stored in the work area 4*b* corresponding to the selected note number with the parts stored in the note map corresponding to the selected note number. Those of the parts that are stored in the note map but not temporarily stored in the work area 4*b* correspond to parts that are generating sound other than the parts assigned this time.

If there are such parts that are generating sound (S42: Yes), the sound source 7 is instructed to stop generating the sound by the parts, and the part numbers stored in the note map corresponding to the selected note are cleared (S43).

When the step S43 is executed, or no part that is generating sound exists other than the parts assigned to the selected note number (S42: No), a judgment is made as to whether the parts assigned to the selected note number are generating sound (S44), and if the parts are not generating sound (S44: No), the sound source 7 is instructed to start sound generation, the note flag corresponding to the note number is set to 1, and part numbers indicating the assigned parts are stored in the note map corresponding to the note number (S45).

When the step S45 is executed, or when the parts assigned to the selected note number are generating sound (S44: Yes), the reassignment flag corresponding to the note number is set to 0 (S46), and a judgment is made as to whether the note map includes any note numbers whose reassignment flags are set to 1 (S47). If there are note numbers with reassignment flags set to 1 (S47: Yes), the process returns to the step S41. If there are no note numbers with reassignment flags set to 1 (S47: No), the sound generation process is finished.

Next, referring to FIG. 10, a correction process is described. FIG. 10 is a flow chart showing the correction process. According to the correction process, first, a judgment is made as to whether a gate time that is a time duration from the time when note-on information of a note is inputted to the time when note-off information of the note is inputted is within a mistouch judgment time MT (S5 1). When the gate time is within the mistouch judgment time MT (S5 1: Yes), it is then judged as to whether the number of depressed keys has changed from two keys to one key (S52). Concretely, by referring to the note map, whether only one note is generating sound is judged. When there is one note that is generating sound, it is judged that the number of depressed keys has changed from two keys to one key. When the number of depressed keys has changed from two keys to one key (S52:

Yes), a pitch difference between the two keys is calculated, and whether or not the pitch difference is within five semitones is judged (S53). The pitch difference between the two keys can be calculated by taking an absolute value of the difference between the note number of the note-off information inputted this time and the note number of the note that is generating sound detected by referring to the note map.

When the pitch difference is within five semitones (S53: Yes), an on-on time between the note corresponding to the note-off information and the note that is generating sound is calculated, and whether the on-on time is within a double stop judgment time JT (S54) is judged. When the on-on time is within the double stop judgment time JT (S54: Yes), it is judged that a mistouch occurs, and the mode flag is set to 0, thereby setting the mode to Unison 1 (S55). Then, the sound source 7 is instructed to start sound generation with a timber of a part that is not assigned to the note that is generating the sound at the same pitch as that of the note that is generating the sound (S56).

On the other hand, when it is judged in the judgment step S51 that the gate time is not within the mistouch judgment time MT (S51: No), it is judged in the judgment step S52 that the number of depressed keys has not changed from two keys to one key (S52: No), it is judged in the judgment step S53 that the pitch difference between two keys is not within five semitones (S53: No), or it is judged in the judgment step S54 that the on-on time is not within the double stop judgment time JT (S54: No), a time difference between the time of input of the note-off information of the note that is turned off and the time of input of the note-on information of the latest note that is currently generating sound, namely, a legato time is calculated, and whether the legato time is within a mis-legato judgment time LT (S57) is judged.

When the legato time is within the mis-legato judgment time LT (S57: Yes), an on-on time with respect to the most recent note that is currently generating sound is calculated, and whether the on-on time is within the double stop judgment time JT (S5 8) is judged. When the on-on time is not within the double stop judgment time JT (S58: No), it is judged that a mis-legato performance is conducted, and parts are reassigned to the notes that are generating sound by the method described with reference to FIG. 4 or a method to be described below with reference to FIG. 12, and the sound source 7 is instructed to start sound generation by the parts newly assigned (S59). In other words, an assignment process according to a flow chart to be described below with reference to FIG. 13 excluding the step S69 in the flow chart is executed. When the step S56 is finished, the process returns to the unison process.

When the on-on time is within the double stop judgment time JT (S58: Yes), it is judged that a chord performance in staccatos is played, and reassignment is not conducted. Also, when it is judged in the judgment step S57 that the legato time is not within the mis-legato judgment time LT (S57: No), the performance is judged not to be a mis-legato performance, and the process returns from the correction process to the unison process.

According to the first embodiment described above, the electronic musical instrument 1 of the invention can switch the mode from Unison 1 to Unison 2 when an on-on time is within the double stop judgment time JT. Therefore, when one of the keys is depressed, the mode is set to Unison 1, wherein all the parts forming a musical instrument arrangement generated sounds at the same pitch. When plural ones of the keys are depressed within a double stop judgment time JT, the mode is set to Unison 2 wherein plural parts forming the musical instrument arrangement are divided and assigned to the plural keys depressed. Therefore it is effective in that, when plural ones of the keys are depressed at the same time like a chord performance, naturally sounding musical sounds can be generated without increasing the number of parts.

Also, when note-off information of a note is inputted, and the gate time of the note is within a mistouch judgment time MT, it is judged to be a mistouch that is not intended, the mode in Unison 2 is returned to Unison 1, and the parts whose sound generation is stopped restart sound generation. Therefore it is effective in that naturally sounding musical sounds can be generated even when a mistouch occurs.

When a legato performance is played in Unison 2, note-off information of a note that is generating sound is inputted immediately after new note-on information is inputted, such that sound generation of parts assigned to the note whose note-off information is inputted would be stopped, but if such a performance is judged as a mis-legato performance, the stopped parts are reassigned to the note that is generating sound. Therefore, a unison performance without changing the number of parts can be conducted, and unintended sound thinning can be prevented.

Next, a method in accordance with a second embodiment is described. In the first embodiment, when the mode is Unison 2, and new note-on information is inputted, reassignment is executed regardless of the presence or the absence of parts that are not used, sound generation of parts that have started sound generation is stopped, and sound generation at a different pitch is started again, such that unnatural discontinuity of musical sound may occur. In accordance with the second embodiment, stop and restart of sound generation can be reduced as much as possible and more naturally sounding musical sound can be generated.

According to the method of the second embodiment, when a new key depression occurs, a sound generation continuation time of a key-depressed note that is generating sound is obtained. When the note has a sound generation continuation time that is longer than a reassignment judgment time ST having a predetermined time duration, the note is not subject to reassignment. The reassignment judgment time ST is longer than the double stop judgment time JT, and may be set, for example, at 80 msec.

Figure 11A:
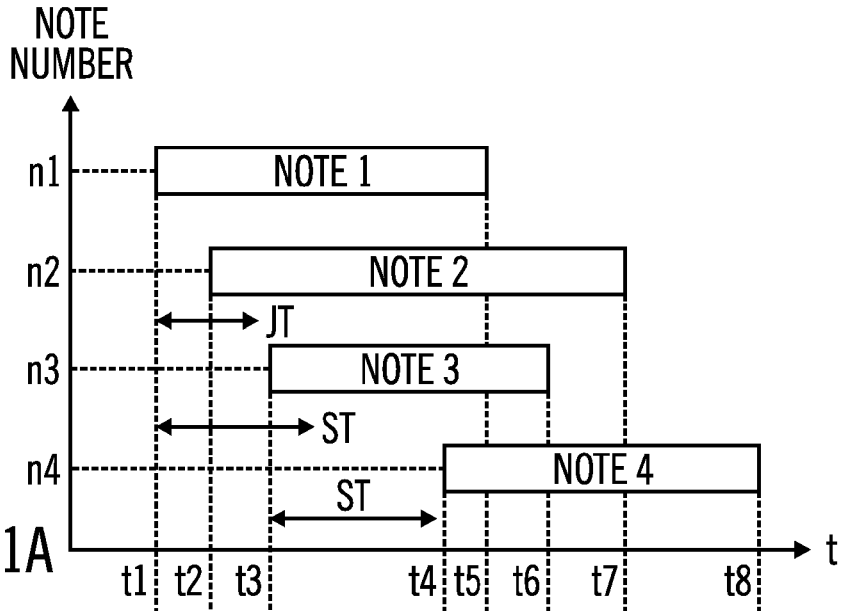
FIGS. 11A and 11B are graphs showing an assigning method in accordance with a second embodiment of the invention, where
Figure 11B:
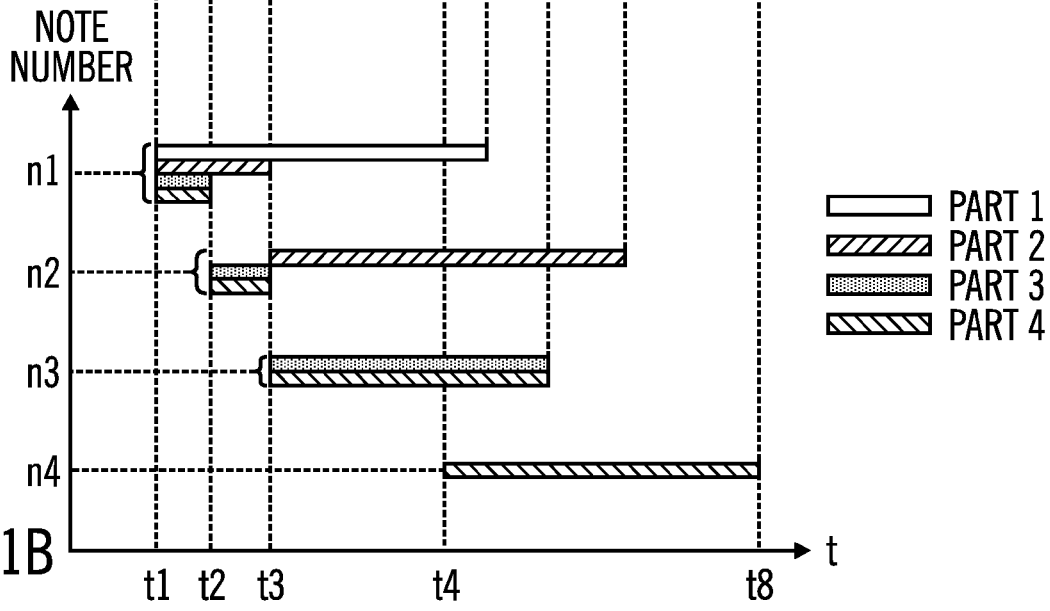

FIGS. 11A and 11B show an example of the process described above, which are graphs corresponding to those in FIGS. 3C and 3D. More specifically, FIG. 11A indicates a key depression state similar to that of FIG. 3C, and FIG. 11B indicates a state of musical sounds in accordance with the second embodiment.

FIG. 11A shows the case where note-on information of Note 1 at pitch n1 is inputted at time t1, note-on information of Note 2 at pitch n2 lower than that of Note 1 is inputted at time t2, note-on information of Note 3 at pitch n3 lower than that of Note 2 is inputted at time t3, and note-on information of Note 4 at pitch n4 lower than that of Note 3 is inputted at time t4; and note-off information of Note 1 is inputted at time t5, note-off information of Note 3 is inputted at time t6, note-off information of Note 2 is inputted at time t7, and note-off information of Note 4 is inputted at time t8. In this example, it is assumed that the on-on time between Note 1 and Note 2 which is a time difference between time t1 and time t2 is within the double stop judgment time JT, and the sound generation continuation time of Note 1 at time t2 is within the reassignment judgment time ST. Also, it is assumed that the sound generation continuation times of Note 1 and Note 2 at time t3 are also within the reassignment judgment time ST, and the sound generation continuation times of Note 1, Note 2 and Note 3 at time t4 are longer than the reassignment judgment time ST.

In this case, as shown in FIG. 11B, when the note-on information of Note 1 is inputted at time t1, the four parts simultaneously start sound generation at pitch n1. When the note-on information of Note 2 at pitch n2 is inputted next at time t2, the on-on time between the Note 1 and Note 2 is within the double stop judgment time JT, such that the mode is changed to Unison 2. Also, as the sound generation continuation time of Note 1 is within the reassignment judgment time ST, Note 1 is subject to reassignment, and therefore, among the four parts that are generating musical sounds at pitch n1, Part 1 (with the timbre being trumpet) and Part 2 (with the timbre being clarinet) which are higher in the pitch order continue generating the musical sounds at pitch n1, and Part 3 (with the timbre being alto saxophone) and Part 4 (with the timbre being trombone) which are lower in the pitch order stop the sound generation at pitch n1, and start sound generation at pitch n2.

Next, the note-on information of Note 3 at pitch n3 is inputted at time t3. At this moment, note-off information of Note 1 and Note 2 has not been inputted, such that the mode is maintained in Unison 2 without regard to the on-on time between Note 2 and Note 3. Also, as the sound generation continuation times of Note 1 and Note 2 are within the reassignment judgment time ST, Note 1 and Note 2 are subject to reassignment, whereby Part 1 (with the timbre being trumpet) that is generating sound at pitch n1 continues the sound generation, Part 2 (with the timbre being clarinet) stops the sound generation and starts sound generation at pitch n2, and Part 3 (with the timbre being alto saxophone) and Part 4 (with the timber being trombone) that are generating the sound at pitch n2 stop the sound generation at pitch n2, and start sound generation at pitch n3.

Next, the note-on information of Note 4 at pitch n4 is inputted at time t4. At this moment, the mode is also maintained in Unison 2 regardless of the on-on time between Note 3 and Note 4, but because the sound generation continuation times of Note 1, Note 2 and Note 3 are longer than the reassignment judgment time ST, Note 1, Note 2 and Note 3 are not subject to reassignment, such that the sound generation by the parts assigned to Notes 1-3 are continued. Further, because the pitch n4 of Note 4 is lower than the pitches n1, n2 and n3 of Notes 1-3, Part 4 (with the timber being trombone) that is the lowest in the pitch order is assigned to Note 4 that is a most recent key-depressed note.

Next, referring to FIGS. 12A-12E, assignment manners in accordance with the second embodiment are described. According to the assignment manners, different assignment manners are applied to the case where unused parts exist and the case where unused parts do not exist. When the mode is Unison 2, multiple notes are key-depressed, and note-off information is inputted upon releasing part of the keys, those of the parts assigned to the key-released note become to be unused parts. For example, as shown in FIG. 3B, when note-off information of Note 1 at pitch n1 is inputted at time t3, Part 1 and Part 2 that are assigned to Note 1 stop the sound generation and become to be unused.

FIGS. 12A-12E are schematic diagrams for describing assignment manners in accordance with the second embodiment. Like the embodiment shown in FIGS. 4A-4F, the musical instrument arrangement includes four parts, and the pitch order is assumed to be set in a manner that Part 1, Part 2, Part 3 and Part 4 are successively set in this order from higher to lower pitch. Also, as described above, notes having a sound generation continuation time longer than the reassignment judgment time ST are not subject to reassignment. In FIGS. 12A-12E, notes that are not subject to reassignment and parts assigned to these notes are shown in shaded rectangles.

Figure 12A:
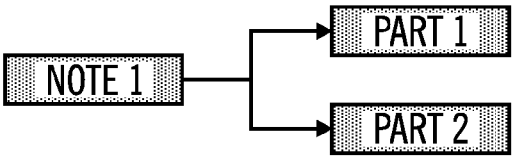
FIGS. 12A-12E schematically show methods of assigning parts to notes when new keys are depressed in Unison 2 in accordance with a second embodiment of the invention.

FIG. 12A shows an example in which unused parts exist, wherein Part 1 and Part 2 are assigned to Note 1, Note 1 has a sound generation continuation time longer than a reassignment judgment time ST, and therefore is not subject to reassignment. Also, Part 3 and Part 4 are in an unused state.

Figure 12B:
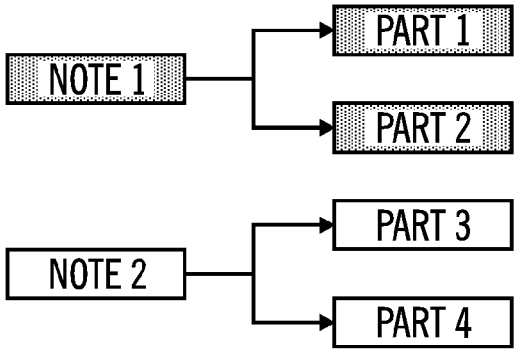

FIG. 12B shows an example in which, in the state shown in FIG. 12A, Note 2 is newly key-depressed. As the pitch of Note 2 is lower than the pitch of Note 1, and Part 3 and Part 4 are lower in the pitch order than Part 1 and Part 2, Part 3 and Part 4 that are unused parts are assigned to the newly key-depressed Note 2, as shown in FIG. 12B. Immediately after the assignment, Note 2, Part 3 and Part 4 become to be subject to reassignment, and therefore shown in white rectangles without shading.

When the pitch of Note 2 is lower than the pitch of Note 1, parts that are unused and lower in the pitch order may be assigned in a manner described above. Similarly, when the pitch of Note 2 is higher than the pitch of Note 1, and unused parts are higher in the pitch order, the unused parts may be assigned to Note 2.

Figure 12C:
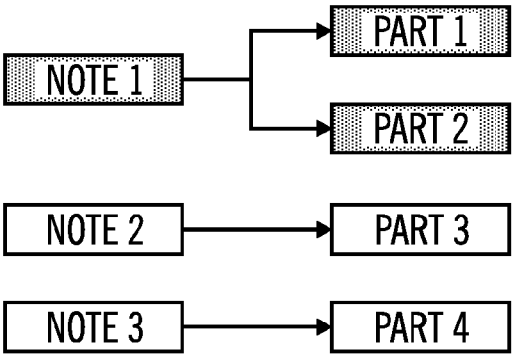

FIG. 12C shows the case where Note 3 having the pitch lower than the pitch of Note 2 is key-depressed in the state shown in FIG. 12B, and within the reassignment judgment time ST measured from the note-on time of Note 2. In this case, no unused parts exist, but because Note 2 has a sound generation continuation time within the reassignment judgment time ST, Note 2 is subject to reassignment, and Part 3 and Part 4 become to be assignable parts. Therefore, Part 3 and Part 4, which have been assigned to Note 2, are reassigned to Note 2 and Note 3 that is newly key-depressed, respectively. Concretely, according to the pitch order of the parts, Part 3 is reassigned to Note 2, and Part 4 is reassigned to Note 3.

Figure 12D:
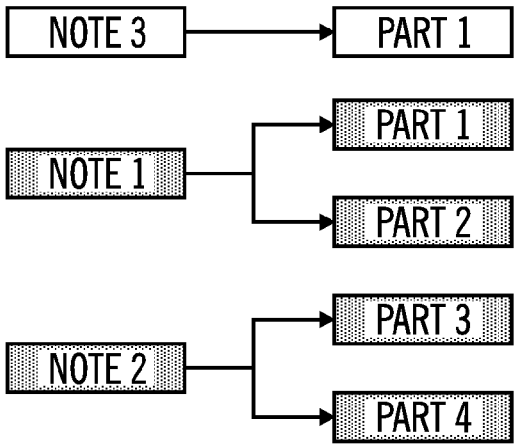
Figure 12E:
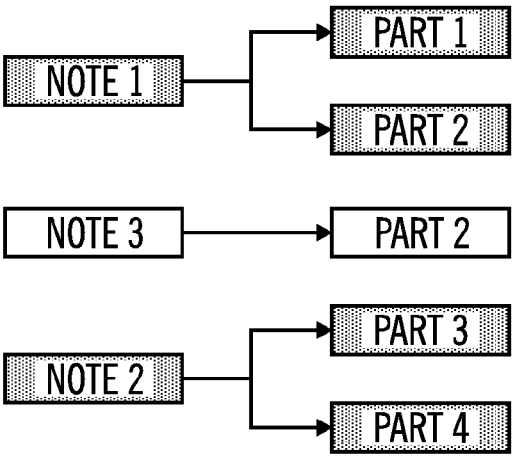

As shown in FIG. 12D, if the pitch of the newly key-depressed Note 3 is higher than the pitch of Note 1, Note 1 and Note 2 are not subject to reassignment, and no assignable parts exist, Part 1 that is highest in the pitch order is assigned to Note 3. As shown in FIG. 12E, if the pitch of the newly key-depressed Note 3 is lower than the pitch of Note 1 but higher than the pitch of Note 2, Note 1 and Note 2 are not subject to reassignment, and no assignable parts exist, Part 2 (or Part 3) that is close in the pitch order is assigned to Note 3.

Figure 13:
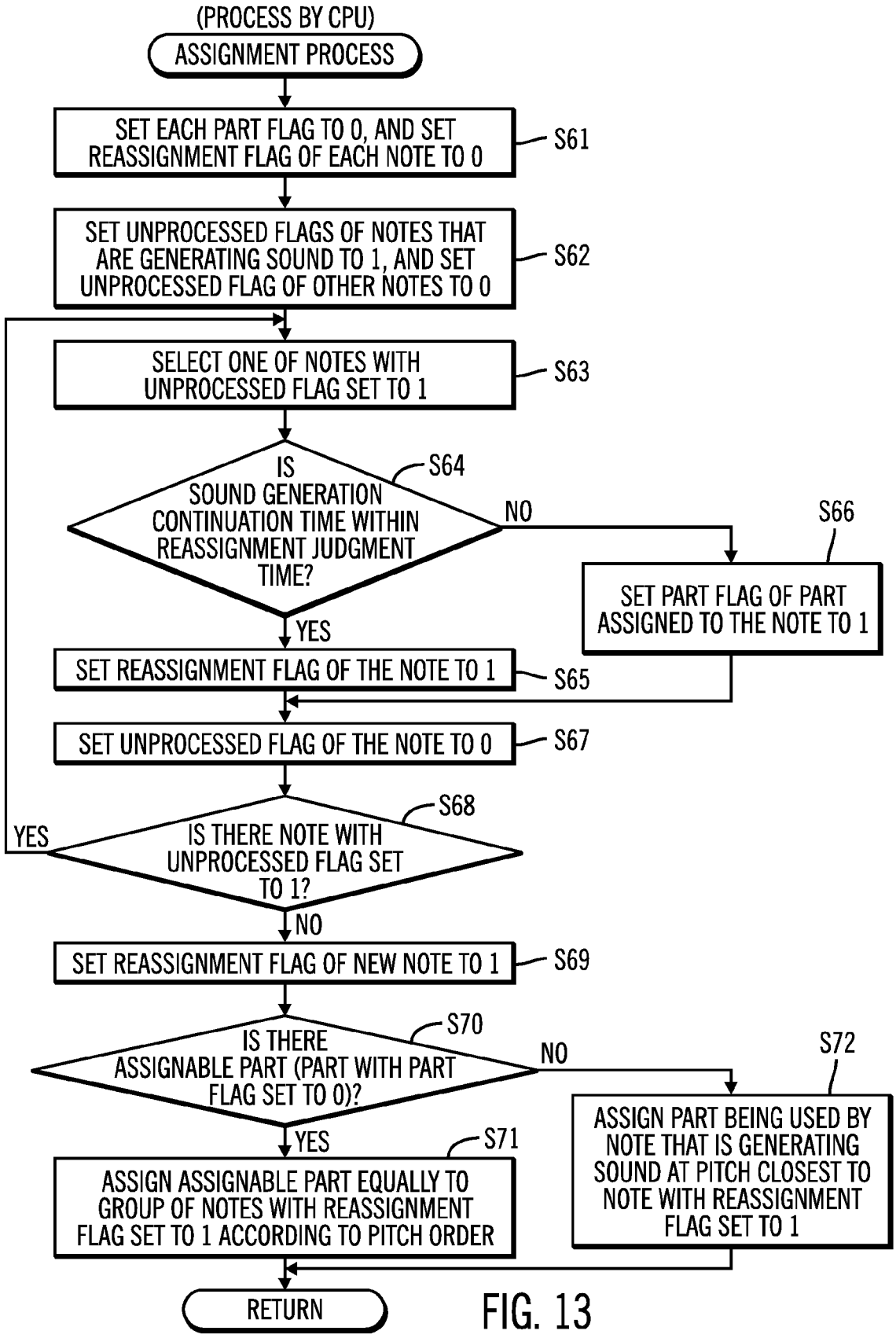
FIG. 13 is a flow chart showing an assignment process in accordance with the second embodiment.

Next, referring to FIG. 13, an assignment process in accordance with the second embodiment is described. FIG. 13 is a flow chart indicating the assignment process in accordance with the second embodiment. The assignment process of the second embodiment may be an alternative process for the assignment process of the first embodiment shown in FIG. 9A. In this process, unprocessed flags corresponding to note numbers are stored in the note map stored in the RAM 4. The unprocessed flags are set in the same manner as note flags, immediately after the assignment process has started. In other words, the unprocessed flag is set to 1 for a note number whose note flag is set to 1, the unprocessed flag is set to 0 for a note number whose note flag is set to 0, and the unprocessed flag set to 1 shall be set to 0 when the judgment step to judge as to assignability is finished.

Also, part flags are stored in the work area 4B of the RAM 4. The part flags are provided corresponding to the respective parts. When a part is assigned to a note and starts sound generation, the corresponding part flag is set to 1, and when the sound generation is stopped, the part flag is set to 0. When a part is assigned to a plurality of notes, the corresponding part flag is set to 0 when all of the notes stop sound generation.

It is noted that other structures and processes in the second embodiment are generally the same as those of the first embodiment.

As shown in FIG. 13, in the assignment process, each of the part flags and each of the reassignment flags are initially set to 0 (S61). Next, unprocessed flags corresponding to notes that are generating sound are set to 1, and unprocessed flags corresponding to notes that are not generating sound are set to 0 (S62). This step may be done by copying the note flags.

Next, one of the notes whose unprocessed flags are set to 1 is selected (S63). Alternatively, for example, the selection may be done by selecting a note with the largest note number or the smallest note number.

Then, a judgment is made as to whether the selected note has a sound generation continuation time within a reassignment judgment time ST having a predetermined time duration (S64). If the sound generation continuation time is within the reassignment judgment time ST (S64: Yes), the reassignment flag corresponding to the note is set to 1 whereby the note is made to be subject to reassignment (S65). If the sound generation continuation time is not within the reassignment judgment time ST (S64: No), the part flag of the part assigned to the note is set to 1 (S66).

When the step S65 or S66 is finished, the unprocessed flag of the note is set to 0 (S67), and it is then judged as to whether notes with unprocessed flags set to 1 exist (S68). If notes with unprocessed flags being set to 1 exist (S68: Yes), the process returns to the step S63. If notes with unprocessed flags set to 1 do not exist (S68: No), reassignment flags corresponding to new notes are set to 1 (S69).

Next, a judgment is made as to whether parts that can be assigned (assignable parts) exist (S70). If there are assignable parts (S70: Yes), the assignable parts are equally assigned according to the pitch order to a group of notes having reassignment flags set to 1 (S71). The assignable parts are parts having part flags set to 0. Concretely, assignable parts are any parts other than parts that are assigned to notes having a sound generation continuation time measured from note-on which is longer than the reassignment judgment time ST. If no assignable parts exist (S70: No), a note with the reassignment flag being set to 1 is assigned a part that is assigned to a note that is generating sound at a pitch closest to the pitch of the aforementioned note, and has a pitch order close to the pitch order to the pitch of the note with the reassignment flag set to 1. When the step S71 or S72 is finished, the sound generation process shown in FIG. 9B is executed, and the process returns to the unison process.

According to the second embodiment, when a note that is generating sound has a sound generation continuation time longer than the reassignment judgment time ST, it is judged that the note that is generating sound has being sounding for sufficiently a long time, and the note is not made to be subject to reassignment. Accordingly, since parts that are assigned to the note that is generating sound are not muted, it is effective in that unnatural discontinuation of sounds can be avoided, and naturally sounding musical sounds can be generated.

It is noted that, according to the first embodiment, when note-on information is inputted, reassignment of parts may occur if the on-on time is within the double stop judgment time JT. Accordingly, some of the parts may stop sound generation immediately after the sound generation has been started, and restart sound generation at a modified pitch. This may give an impression that the musical sounds become muddy. To address this issue, when note-on information is inputted, sound generation may be made to start after a predetermined delay time d. As a result, if another set of note-on information is inputted within the delay time d, and parts are assigned to the note, the note that was in note-on (key-depressed) earlier has not started sound generation as being in the delay time, whereby stop of sound generation immediately after it has been started can be avoided, and musical sounds can be prevented from becoming muddy.

Figure 14A:
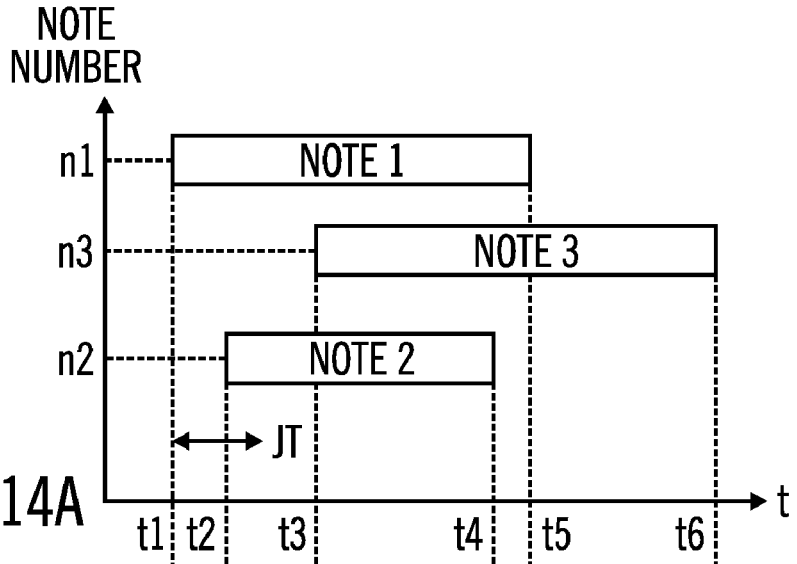
FIGS. 14A-14C are graphs for describing a process to prevent musical sounds from becoming muddy, where
Figure 14B:
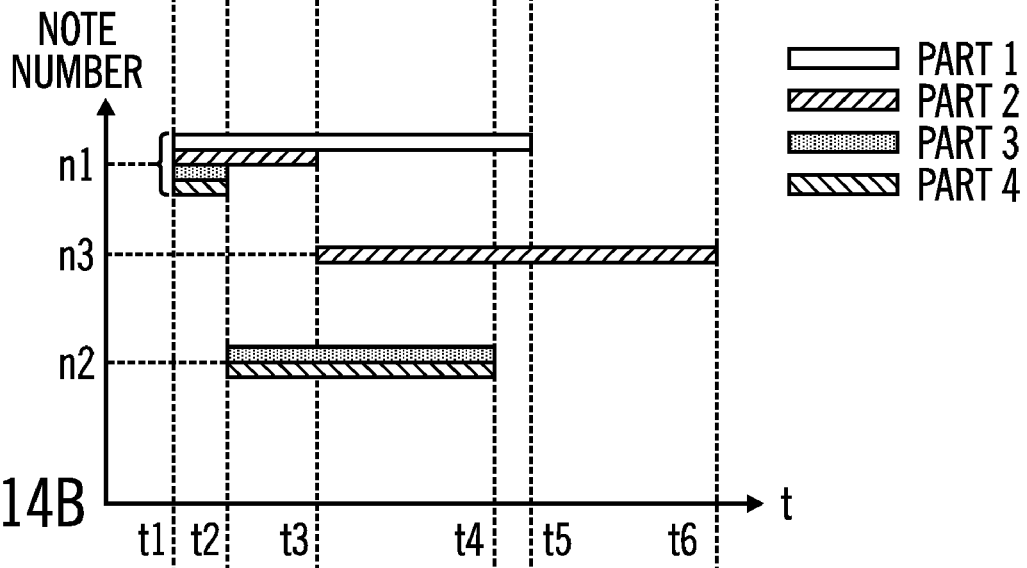
Figure 14C:
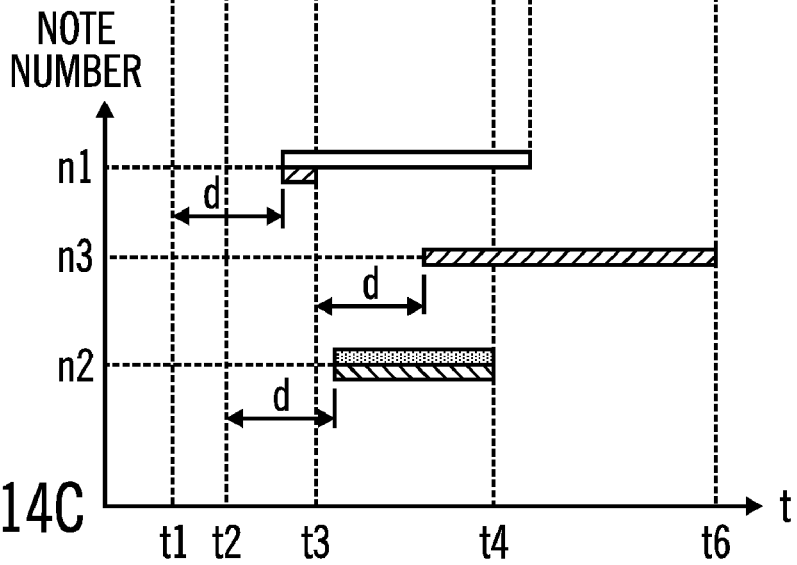

FIGS. 14A-14C are graphs showing a method to prevent musical sounds from becoming muddy. FIG. 14A is a graph showing a key depression state, FIG. 14B is a graph showing a state of musical sounds when the delay time d is not provided, and FIG. 14C is a graph showing a state of musical sounds when the delay time d is provided.

FIG. 14A shows the case where note-on information of Note 1 at pitch n1 is inputted at time t1, note-on information of Note 2 at pitch n2 lower than the pitch n1 of Note 1 is inputted at time t2, and note-on information of Note 3 at pitch n3 lower than the pitch n 1 of Note 1 and higher than the pitch n2 of Note 2 is inputted at time t3; and note-off information of Note 2 is inputted at time t4, note-off information of Note 1 is inputted at time t5, and note-off information of Note 3 is inputted at time t6. Furthermore, the graph shows the case where the on-on time that is a time difference between time t1 and time t2 is within the double stop judgment time JT.

In this case, when the delay time d is not provided, as indicated in FIG. 14B, the four parts simultaneously start sound generation at pitch n1 at time t1. When note-on information of Note 2 is inputted at time t2, the mode is switched from Unison 1 to Unison 2 as the on-on time is within the double stop judgment time JT, generation of musical sounds by Part 3 and Part 4 that are generating the musical sounds at pitch n1 is stopped, and generation of musical sounds by Part 3 and Part 4 at pitch n2 is started. Next, when note-on information of Note 3 is inputted at time t3, as the mode is Unison 2, generation of musical sound by Part 2 that is generating the musical sound at pitch n1 is stopped, and generation of musical sound by Part 2 at pitch n3 is started.

FIG. 14C shows the case where a delay time d is provided, in which time measurement of the delay time d is started at time t1, and start of sound generation of all the parts, Part 1-Part 4, is delayed by the delay time d. Next, when note-on information of Note 2 is inputted at time t2 that is within the delay time d, the mode is switched from Unison 1 to Unison 2 as the on-on time is within the double stop judgment time JT, and Part 3 and Part 4 are assigned to Note 2, but start of sound generation by Part 3 and Part 4 is delayed from time t2 by the delay time d.

When the delay time d has elapsed from time t1, Part 1 and Part 2 start sound generation at pitch n1; and when note-on information of Note 3 is inputted at time t3, Part 2 that is generating sound at pitch n1 is stopped, and Part 2 is assigned to Note 3, and set with a delay time d. Then, when the delay time d has elapsed from time t2, Part 3 and Part 4 start sound generation at pitch n2; and when the delay time d has elapsed from time t3, Part 2 starts sound generation at pitch n3.

Provision of the delay time d in this manner can suppress the phenomenon in which the musical sound by Part 3 and Part 4 that started sound generation at time t1 is stopped immediately thereafter at time t2, and sound generation by them at a modified pitch is started again, whereby the musical sound can be prevented from becoming muddy.

To realize the method described above, the sound source 7 is equipped with the following functions. For example, the sound source 7 measures the delay time d from the time when an instruction to start sound generation is inputted, and starts the sound generation after the delay time d elapsed. When an instruction to stop the sound generation is inputted within the delay time d, time measurement of the delay time d is stopped, and the sound generation is not started.

Provision of the delay time d before starting sound generation can suppress the phenomenon in which generation of musical sound is stopped immediately after it has been started due to reassignment and musical sounds become muddy, even when new note-on information is inputted during the delay time d.

Embodiments of the invention are described above. However, the invention is not at all limited to the embodiments described above, and it can be readily understood that many improvements and changes can be made within the range that does not depart from the subject matter of the invention.

For example, in the embodiments described above, the sound source 7 is described as being built in the electronic musical instrument 1, and connected through the bus to the CPU 2, but may be provided as an external sound source that may be connected externally through the MIDI interface 6.

It is noted that, in the embodiments described above, although not particularly described, the system for generating musical sounds by the sound source 7 may use a system that stores waveforms of various musical instruments and reads out the waveforms to generate musical sounds with desired timbres, or a system that modulates a basic waveform such as a rectangular waveform to generate musical sounds.

What is claimed is:

1. An electronic musical instrument, comprising:

an input device that inputs a sound generation instruction that instructs to start generating a musical sound at a predetermined pitch and a stop instruction that instructs to stop the musical sound being generated by the sound generation instruction;

a processor;

a computer readable storage medium having a control program executed by the processor to perform operations, the operations comprising:

generating a first musical sound at a first pitch in response to processing a first sound generation instruction from the input device, where the first musical sound comprises a plurality of parts comprising different timbres of different musical instruments;

receiving a second sound generation instruction from the input device to generate a second musical sound at a second pitch while generating the first musical sound;

determining whether a processing mode comprises a first or second processing mode;

switching the processing mode from the first processing mode to the second processing mode based on a first time at which the first sound generation instruction was received and a second time at which the second sound generation instruction was received;

in response to determining that the processing mode comprises the first processing mode, stopping the generating of the first musical sound and generating the second musical sound using the plurality of parts;

in response to determining that the processing mode comprises the second processing mode, assigning a plurality of parts to the first and second pitches by dividing the parts among the first and the second pitches and generating the first and the second pitches with the parts assigned to each to generate the first and second musical sounds.

2. The electronic musical instrument of claim 1, wherein the switching of the processing mode comprises:

determining whether a difference of the first time and the second time is less than a predetermined time; and switching the processing mode from the first processing mode to the second processing mode in response to determining that the difference of the first and second times is less than the predetermined time.

3. The electronic musical instrument of claim 1, wherein the operations further comprise:

in response to determining that a number of sound generation instructions to which corresponding sound stop instructions are not inputted becomes zero, processing a next musical sound whose sound generation is instructed by a next sound generation instruction inputted by the input device is controlled and generated according to the first processing mode wherein the plurality of parts are assigned to generate the next musical sound.

4. The electronic musical instrument of claim 1, in response to the musical sounds being processed in the second processing mode and a number of sound generation instructions to which corresponding sound stop instructions are not inputted becomes one, a next musical sound whose sound generation is instructed by a next sound generation instruction inputted by the input device is controlled and generated according to the first processing mode wherein the plurality of parts are assigned to generate the next musical sound.

5. The electronic musical instrument according of claim 1, further comprising:

a gate time timer device that measures a time difference between a sound generation instruction inputted by the input device and a stop instruction that instructs to stop a musical sound generated in response to the sound generation instruction; and wherein the operations further comprise:

in response to generating the first and second musical sounds in the second processing mode and receiving a stop instruction inputted to instruct to stop the first musical sound, determining whether a time difference between the first sound generation instruction and the stop instruction measured by the gate time timer device is within a mistouch judgment time having a predetermined time duration;

in response to determining that the time difference is within the mistouch judgment time, stopping the musical sound generated by the first sound generation instruction and assigning parts among the predetermined number of parts which are not assigned to the second musical sound to the second musical sound wherein the plurality of parts are assigned to generate a next musical sound to generate the second musical sound according to the first processing mode.

6. A method implemented in an electronic musical instrument for generating electronic musical sounds, comprising:

receiving a first input of a first sound generation instruction to generate a first musical sound at a first predetermined pitch;

generating a plurality of parts comprising different timbres of different musical instruments at the first predetermined pitch to produce the first musical sound;

receiving a second input of a second sound generation instruction to generate a second musical sound at a second predetermined pitch prior to receiving a stop instruction for the first musical sound;

determining whether a time between receiving the first input and the second input is within a predetermined time;

in response to determining that the time exceeds the predetermined time, stopping the generation of the parts for the first musical sound and generating the plurality of parts at the second predetermined pitch to produce the second musical sound, wherein the parts at the second predetermined pitch comprise the timbres for the different musical instruments; and in response to determining that the time does not exceed the predetermined time, concurrently generating at least one of the parts at the first predetermined pitch to produce the first musical sound and at least one of the parts at the second predetermined pitch to produce the second musical sound, wherein at least one part generated for the first predetermined pitch is not generated for the second predetermined pitch.

7. The method of claim 6, further comprising:

receiving a third input of a third sound generation instruction to generate a third musical sound at a third predetermined pitch prior to receiving a stop instruction for the first and second musical sounds when the time does not exceed the predetermined time; and generating at least one of the parts at the first predetermined pitch to produce the first musical sound, at least one of the parts at the second predetermined pitch to produce the second musical sound, and at least one of the parts at the third predetermined pitch to produce the third musical sound, wherein at least one part generated for the third predetermined pitch is not generated for the first and second predetermined pitches.

8. The method of claim 6, further comprising:

receiving a third input of a third sound generation instruction to generate a third musical sound at a third predetermined pitch after receiving stop instructions for the first and second musical sounds; and generating the plurality of the parts at the third predetermined pitch to produce the third musical sound.

9. The method of claim 6, further comprising:

determining that the first input is a mistouch after generating at least one of the parts at the first predetermined pitch and at least one of the parts at the second predetermined pitch to produce the second musical sound in response to determining that the time does not exceed the predetermined time; and generating the plurality of parts at the second predetermined pitch in response to determining that the first input is the mistouch, wherein parts generated at the first predetermined pitch not generated at the second predetermined pitch prior to determining the mistouch are included in the parts generated at the second predetermined pitch in response to determining the mistouch.

10. The method of claim 9, wherein the determined time comprises a first time and the predetermined time comprises a first predetermined time, wherein determining that the first input is the mistouch comprises determining that a second time from receiving the first input to a stop instruction for the first musical sound is less than a second predetermined time.

11. An electronic musical instrument to generate musical sounds at different pitches, comprising:

an input device for receiving sound generation instructions to start and stop generating musical sounds;

a processor;

a computer readable storage medium including a control program executed by the processor to perform operations, the operations comprising:

receiving a first input from the input device of a first sound generation instruction to generate a first musical sound at a first predetermined pitch;

generating a plurality of parts comprising different timbres of different musical instruments at the first predetermined pitch to produce the first musical sound;

receiving a second input from the input device of a second sound generation instruction to generate a second musical sound at a second predetermined pitch prior to receiving a stop instruction for the first musical sound;

determining whether a time between receiving the first input and the second input is within a predetermined time;

in response to determining that the time exceeds the predetermined time, stopping the generation of the parts for the first musical sound and generating the plurality of parts at the second predetermined pitch to produce the second musical sound, wherein the parts at the second predetermined pitch comprise the timbres for the different musical instruments; and in response to determining that the time does not exceed the predetermined time, concurrently generating at least one of the parts at the first predetermined pitch to produce the first musical sound and at least one of the parts at the second predetermined pitch to produce the second musical sound, wherein at least one part generated for the first predetermined pitch is not generated for the second predetermined pitch.

12. The electronic musical instrument of claim 11, wherein the operations further comprise:

receiving a third input of a third sound generation instruction to generate a third musical sound at a third predetermined pitch prior to receiving a stop instruction for the first and second musical sounds; and generating at least one of the parts at the first predetermined pitch to produce the first musical sound, at least one of the parts at the second predetermined pitch to produce the second musical sound, and at least one of the parts at the third predetermined pitch to produce the third musical sound, wherein at least one part generated for the third predetermined pitch is not generated for the first and second predetermined pitches.

13. The electronic musical instrument of claim 11, wherein the operations further comprise:

receiving a third input of a third sound generation instruction to generate a third musical sound at a third predetermined pitch after receiving stop instructions for the first and second musical sounds; and generating the plurality of the parts at the third predetermined pitch to produce the third musical sound.

14. The electronic musical instrument of claim 11, wherein the operations further comprise:

determining that the first input is a mistouch after generating at least one of the parts at the first predetermined pitch and at least one of the parts at the second predetermined pitch to produce the second musical sound in response to determining that the time does not exceed the predetermined time; and generating the plurality of parts at the second predetermined pitch in response to determining that the first input is the mistouch, wherein parts generated at the first predetermined pitch not generated at the second predetermined pitch prior to determining the mistouch are included in the parts generated at the second predetermined pitch in response to determining the mistouch.

15. The electronic musical instrument of claim 14, wherein the determined time comprises a first time and the predetermined time comprises a first predetermined time, wherein determining that the first input is the mistouch comprises determining that a second time from receiving the first input and a stop instruction for the first musical sound is less than a second predetermined time.

16. A computer readable storage medium having code executed by a processor in an electronic musical instrument for generating electronic musical sounds by performing operations, the operations comprising:

receiving a first input of a first sound generation instruction to generate a first musical sound at a first predetermined pitch;

generating a plurality of parts comprising different timbres of different musical instruments at the first predetermined pitch to produce the first musical sound;

receiving a second input of a second sound generation instruction to generate a second musical sound at a second predetermined pitch prior to receiving a stop instruction for the first musical sound;

determining whether a time between receiving the first input and the second input is within a predetermined time;

in response to determining that the time exceeds the predetermined time, stopping the generation of the parts for the first musical sound and generating the plurality of parts at the second predetermined pitch to produce the second musical sound, wherein the parts at the second predetermined pitch comprise the timbres for the different musical instruments; and in response to determining that the time does not exceed the predetermined time, concurrently generating at least one of the parts at the first predetermined pitch to produce the first musical sound and at least one of the parts at the second predetermined pitch to produce the second musical sound, wherein at least one part generated for the first predetermined pitch is not generated for the second predetermined pitch.

17. The computer readable storage medium of claim 16, wherein the operations further comprise:

receiving a third input of a third sound generation instruction to generate a third musical sound at a third predetermined pitch prior to receiving a stop instruction for the first and second musical sounds; and generating at least one of the parts at the first predetermined pitch to produce the first musical sound, at least one of the parts at the second predetermined pitch to produce the second musical sound, and at least one of the parts at the third predetermined pitch to produce the third musical sound, wherein at least one part generated for the third predetermined pitch is not generated for the first and second predetermined pitches.

18. The computer readable storage medium of claim 16, wherein the operations further comprise:

receiving a third input of a third sound generation instruction to generate a third musical sound at a third predetermined pitch after receiving stop instructions for the first and second musical sounds; and generating the plurality of the parts at the third predetermined pitch to produce the third musical sound.

19. The computer readable storage medium of claim 16, wherein the operations further comprise:

determining that the first input is a mistouch after generating at least one of the parts at the first predetermined pitch and at least one of the parts at the second predetermined pitch to produce the second musical sound in response to determining that the time does not exceed the predetermined time; and generating the plurality of parts at the second predetermined pitch in response to determining that the first input is the mistouch, wherein parts generated at the first predetermined pitch not generated at the second predetermined pitch prior to determining the mistouch are included in the parts generated at the second predetermined pitch in response to determining the mistouch.

20. The computer readable storage medium of claim 19, wherein the determined time comprises a first time and the predetermined time comprises a first predetermined time, wherein determining that the first input is the mistouch comprises determining that a second time from receiving the first input and a stop instruction for the first musical sound is less than a second predetermined time.

* * * * *